US012514349B2

(12) United States Patent
Meersschaert et al.

(10) Patent No.: US 12,514,349 B2
(45) Date of Patent: Jan. 6, 2026

(54) LUGGAGE WITH A RECESSED ZIPPER

(71) Applicant: Samsonite IP Holdings S.a r.l., Luxembourg (LU)

(72) Inventors: Reinhard Meersschaert, Merelbeke (BE); Dirk Santy, Koekelare (BE)

(73) Assignee: Samsonite IP Holdings S.a r.l., Luxembourg (LU)

( * ) Notice: Subject to any disclaimer, the term of this patent is extended or adjusted under 35 U.S.C. 154(b) by 192 days.

(21) Appl. No.: 18/114,341

(22) Filed: Feb. 27, 2023

(65) Prior Publication Data

US 2023/0276914 A1 Sep. 7, 2023

Related U.S. Application Data

(63) Continuation of application No. 13/882,455, filed as application No. PCT/EP2011/069011 on Oct. 28, 2011, now Pat. No. 11,786,021.

(Continued)

(51) Int. Cl.
*A45C 5/03* (2006.01)
*A45C 5/00* (2006.01)

(Continued)

(52) U.S. Cl.
CPC ..... *A45C 5/03* (2013.01); *A45C 5/02* (2013.01); *A45C 13/103* (2013.01); *A45C 13/26* (2013.01);

(Continued)

(58) Field of Classification Search
CPC ..... A45C 5/03; A45C 5/02; A45C 13/103; A45C 13/26; A45C 13/36; A45C 5/00; A45C 7/0022
See application file for complete search history.

(56) References Cited

U.S. PATENT DOCUMENTS 1,029,634 A 6/1912 Riley
1,808,375 A 6/1931 Plooster (Continued)

FOREIGN PATENT DOCUMENTS

CN 1167429 A 12/1997
CN 1315157 A 10/2001

(Continued)

OTHER PUBLICATIONS

International Search Report for International Application No. PCT/EP2011/069011, dated Aug. 3, 2012, 6 pages.

(Continued)

*Primary Examiner* — Tri M Mai
(74) *Attorney, Agent, or Firm* — Dorsey & Whitney LLP

(57) ABSTRACT

A piece of luggage may include a front side, a rear side, a top side, a bottom side, a right side and a left side that define an enclosed space. The enclosed space may be divided into one or more compartments. The luggage may further include at least one zipper to access the enclosed space. The at least one zipper may include a zipper track, at least one zipper slider, and at least on zipper tab. At least a portion of the zipper track may be positioned within one or more recessed areas defined by at least some of the sides of the luggage. In some embodiments, the zipper track may be positioned within the one or more recessed areas along substantially the entire length of the zipper track.

10 Claims, 25 Drawing Sheets

Related U.S. Application Data

(60) Provisional application No. 61/408,346, filed on Oct. 29, 2010.

(51) Int. Cl.

| | |
|---|---|
| ***A45C 5/02*** | (2006.01) |
| ***A45C 7/00*** | (2006.01) |
| ***A45C 13/10*** | (2006.01) |
| ***A45C 13/26*** | (2006.01) |
| ***A45C 13/36*** | (2006.01) |

(52) U.S. Cl.

CPC ..... *A45C 13/36* (2013.01); *A45C 5/00* (2013.01); *A45C 7/0022* (2013.01)

(56) References Cited

U.S. PATENT DOCUMENTS

| | | | | |
|---|---|---|---|---|
| 2,105,319 | A | 1/1938 | Hedden et al. | |
| 2,115,424 | A | 4/1938 | Geno | |
| 2,154,235 | A * | 4/1939 | Esterow | A45C 13/103 220/DIG. 26 |
| 2,218,666 | A * | 10/1940 | Tamoschat | A24F 15/12 220/DIG. 26 |
| 2,298,786 | A | 10/1942 | Dubofsky et al. | |
| 2,373,573 | A | 4/1945 | Langford et al. | |
| 2,420,150 | A | 5/1947 | Riess | |
| 2,439,660 | A | 4/1948 | Rudolph | |
| 2,492,655 | A * | 12/1949 | Rubin | A41H 37/003 190/127 |
| 2,706,024 | A | 4/1955 | Kish, Jr. | |
| 2,839,167 | A | 6/1958 | Smith | |
| 3,158,238 | A * | 11/1964 | Kish, Jr. | A45C 5/02 206/315.9 |
| 3,165,178 | A | 1/1965 | Pelavin et al. | |
| 3,330,389 | A | 7/1967 | Kaplan | |
| 3,443,671 | A * | 5/1969 | Dyke | A45C 7/0027 383/61.3 |
| 3,447,649 | A | 6/1969 | Kish, Jr. | |
| 3,736,621 | A | 6/1973 | Szabo | |
| 3,944,032 | A | 3/1976 | Samhammer et al. | |
| 4,004,664 | A | 1/1977 | Pelavin et al. | |
| 4,026,750 | A | 5/1977 | Szabo | |
| 4,055,239 | A | 10/1977 | Weiner | |
| 4,123,839 | A | 11/1978 | Weiner | |
| 4,176,734 | A | 12/1979 | Wang | |
| 4,298,104 | A | 11/1981 | Leong | |
| 4,539,705 | A | 9/1985 | Baines | |
| 4,573,203 | A | 2/1986 | Peppiatt | |
| 4,598,802 | A | 7/1986 | Abenaim | |
| 4,610,334 | A | 9/1986 | Palavin | |
| 4,658,998 | A | 4/1987 | Belka | |
| 4,762,211 | A | 8/1988 | Krenzel | |
| 4,781,278 | A | 11/1988 | Sadow | |
| 4,782,556 | A | 11/1988 | Kim | |
| 4,823,924 | A | 4/1989 | Goodin | |
| 4,838,709 | A | 6/1989 | Guerriero et al. | |
| D302,077 | S | 7/1989 | Kim | |
| 4,867,575 | A | 9/1989 | Wood | |
| 4,874,255 | A | 10/1989 | Ball et al. | |
| 4,895,230 | A | 1/1990 | King | |
| 4,907,728 | A | 3/1990 | Giblet | |
| 4,971,645 | A | 11/1990 | Licus | |
| D315,285 | S | 3/1991 | Workman | |
| 5,031,734 | A | 7/1991 | King | |
| 5,036,978 | A | 8/1991 | Frank et al. | |
| 5,096,106 | A | 3/1992 | Foster et al. | |
| 5,111,919 | A * | 5/1992 | Hamatani | A45C 5/03 206/810 |
| 5,113,983 | A | 5/1992 | Workman | |
| 5,115,895 | A | 5/1992 | Myers | |
| 5,121,995 | A | 6/1992 | Newman et al. | |
| 5,129,127 | A | 7/1992 | Hamatani | |
| 5,181,590 | A | 1/1993 | Carpenter et al. | |
| 5,197,580 | A | 3/1993 | Berman et al. | |
| 5,253,792 | A | 10/1993 | Foster et al. | |
| 5,282,687 | A | 2/1994 | Yee | |
| 5,303,805 | A | 4/1994 | Hauser | |
| 5,310,031 | A | 5/1994 | Plath | |
| 5,386,616 | A | 2/1995 | Norvell | |
| D368,489 | S | 4/1996 | Gray | |
| 5,528,453 | A | 6/1996 | Berman et al. | |
| 5,529,156 | A | 6/1996 | Yang | |
| 5,560,459 | A | 10/1996 | Lin | |
| 5,620,069 | A | 4/1997 | Hurwitz | |
| 5,634,539 | A | 6/1997 | Gordon | |
| D380,774 | S | 7/1997 | Gray | |
| 5,755,311 | A * | 5/1998 | Younessian | E05B 65/5238 190/122 |
| 5,819,890 | A | 10/1998 | Lin et al. | |
| 5,826,717 | A | 10/1998 | Eskandry | |
| 5,894,007 | A | 4/1999 | Younessian et al. | |
| 5,897,209 | A | 4/1999 | Roegner | |
| D413,627 | S | 9/1999 | Gray | |
| 5,950,779 | A | 9/1999 | Miyoshi | |
| D419,853 | S | 2/2000 | Workman et al. | |
| 6,076,666 | A | 6/2000 | Santa-Maria | |
| 6,119,835 | A | 9/2000 | Lin | |
| 6,148,973 | A | 11/2000 | Chang | |
| D437,202 | S | 2/2001 | O'Neil | |
| 6,260,680 | B1 | 7/2001 | Lin | |
| 6,283,261 | B1 | 9/2001 | Sher | |
| 6,293,378 | B1 | 9/2001 | Lin | |
| D460,677 | S | 7/2002 | Proot et al. | |
| D461,055 | S | 8/2002 | Szyf | |
| RE37,924 | E | 12/2002 | Kellogg et al. | |
| 6,520,514 | B2 | 2/2003 | Clegg | |
| 6,618,914 | B1 | 9/2003 | Chen | |
| 6,634,496 | B2 | 10/2003 | Scoglio | |
| D489,531 | S | 5/2004 | Oh | |
| 6,892,434 | B2 | 5/2005 | Fenton et al. | |
| D507,734 | S | 7/2005 | Willems | |
| 6,953,110 | B2 | 10/2005 | Santy et al. | |
| D526,784 | S | 8/2006 | Proot | |
| D539,034 | S | 3/2007 | Friedman | |
| 7,207,426 | B2 | 4/2007 | Godshaw et al. | |
| 7,281,615 | B2 | 10/2007 | Gorga et al. | |
| D554,372 | S | 11/2007 | Scicluna et al. | |
| 7,458,600 | B1 | 12/2008 | Berke et al. | |
| D600,095 | S | 9/2009 | Mattson et al. | |
| 8,668,064 | B2 | 3/2014 | Santy et al. | |
| 2001/0034923 | A1 | 11/2001 | Ho | |
| 2002/0100148 | A1 | 8/2002 | Tominaga et al. | |
| 2002/0139627 | A1 | 10/2002 | Mahanavanont | |
| 2002/0148694 | A1 | 10/2002 | Tong | |
| 2004/0070242 | A1 | 4/2004 | Illulian | |
| 2004/0154889 | A1 | 8/2004 | Gifford et al. | |
| 2004/0182667 | A1 | 9/2004 | Lin | |
| 2005/0051586 | A1 | 3/2005 | Siwak et al. | |
| 2005/0056511 | A1 | 3/2005 | Hsieh | |
| 2005/0263364 | A1 | 12/2005 | Sher | |
| 2006/0064852 | A1 | 3/2006 | Willems | |
| 2006/0137951 | A1 | 6/2006 | Lai | |
| 2007/0086845 | A1 | 4/2007 | Merzon | |
| 2009/0022430 | A1 | 1/2009 | Hutchinson et al. | |
| 2009/0277937 | A1 | 11/2009 | Sabbag | |
| 2011/0088987 | A1 | 4/2011 | Santy et al. | |
| 2011/0168506 | A1 | 7/2011 | Santy et al. | |
| 2013/0037363 | A1 | 2/2013 | Palmer et al. | |
| 2013/0220755 | A1 | 8/2013 | Meersschaert et al. | |
| 2013/0334081 | A1 | 12/2013 | Loudenslager et al. | |

FOREIGN PATENT DOCUMENTS

| | | |
|---|---|---|
| CN | 201011903 Y | 1/2008 |
| CN | 201123480 | 10/2008 |
| CN | 201175054 | 1/2009 |
| DE | 202007013485 U1 | 11/2007 |
| DE | 20-2010-017619 | 3/2012 |
| EM | 000036710-0006 | 5/2003 |
| EM | 000036710-0007 | 5/2003 |
| EM | 000036710-0009 | 5/2003 |
| EM | 001241350-0001 | 10/2010 |
| EP | 2512279 | 9/2018 |

(56) References Cited

FOREIGN PATENT DOCUMENTS

| | | | |
|---|---|---|---|
| EP | 2632290 | | 9/2019 |
| EP | 3659462 | A1 | 6/2020 |
| FR | 43918 | | 9/1934 |
| FR | 1032424 | | 3/1953 |
| FR | 2375801 | A7 | 7/1978 |
| FR | 2531843 | A1 | 2/1984 |
| GB | 349755 | A | 6/1931 |
| GB | 851184 | | 10/1960 |
| GB | 2184940 | A | 7/1987 |
| GB | 2433065 | | 6/2007 |
| WO | 94/19981 | A1 | 9/1994 |
| WO | 99/44460 | A1 | 9/1999 |
| WO | 2007014804 | A1 | 2/2007 |
| WO | 2008/098116 | A1 | 8/2008 |
| WO | 2011073451 | | 6/2011 |
| WO | 2012056009 | | 5/2012 |

OTHER PUBLICATIONS

Extended European Search Report for European Patent Application No. 19199261.9 dated May 4, 2020, 10 pages.

* cited by examiner 280
275

280

275
280

275

275

LUGGAGE WITH A RECESSED ZIPPER

CROSS-REFERENCE TO RELATED APPLICATIONS

This application is a continuation of U.S. patent application Ser. No. 13/882,455, filed on Apr. 29, 2013 and entitled "Luggage With a Recessed Zipper" which is the national stage application of PCT Patent Application No. PCT/EP2011/069011, filed on Oct. 28, 2011 and entitled "Luggage With a Recessed Zipper," which claims the benefit, under 35 U.S.C. § 119(e), of U.S. provisional application No. 61/408,346, entitled "Luggage with a Recessed Zipper" and filed on Oct. 29, 2010, the entire contents of which are hereby incorporated by reference herein.

TECHNOLOGICAL FIELD

The technological field generally relates to luggage.

BACKGROUND

Zippers are often provided on luggage to access luggage compartments. Each zipper typically includes a zipper track, a zipper slider, and a zip pull tab. For zippers positioned on the exterior of the luggage, the zipper track is typically positioned approximately flush with an outer surface of the luggage. Such a configuration makes the zipper track susceptible to being damaged from contact with other objects. Further, in such a configuration, the zipper slider usually projects outwardly from the outer surface of the luggage. This outward projection also makes the zipper slider vulnerable to being damaged.

SUMMARY

One embodiment of a luggage piece may include at least six sides defining an enclosed space and a zipper positioned along at least one side of the at least six sides. The zipper and the at least one side may be configured so that the zipper provides access to the enclosed space. The zipper may include a zipper track. A first segment of the zipper track may be recessed relative to an outermost surface of the at least one side. A second segment of the zipper track may be positioned at approximately the outermost surface of the at least one side.

Another embodiment of a luggage piece may include a front side, a rear side, a right side, a left side, a top side, and a bottom side. The front, rear, right, left, top, and bottom sides may define an enclosed space. A zipper may be positioned along at least portions of the right, left, top, and bottom sides. The zipper and the right, left, top, and bottom sides may be configured so that the zipper provides access to the enclosed space. The zipper may include a zipper track. A first segment of the zipper track may be recessed relative to an outermost surface of the top side, and a second segment of the zipper track may be positioned at approximately the outermost surface of the top side.

Yet another embodiment of a luggage piece may include a base, a lid and a zipper. The lid may be pivotally joined to the base to pivot between at least a first position where the base and the lid define a substantially enclosed space and a second position to allow access to the substantially enclosed space. The lid and the base together may define an area recessed relative to outermost surfaces of the lid and the base when the lid and the base are configured in the first position. The zipper may maintain the lid and the base in the first position. The zipper may be joined to the lid and the base at least within the recessed area.

Another embodiment of a luggage piece may include a base, a lid, and a zipper. The lid may be pivotally joined to the base to pivot between at least a first position where the base and the lid define a substantially enclosed space and a second position to allow access to the substantially enclosed space. The zipper may be configured in a first configuration to secure the lid and the base in the first position and in a second configuration to allow the lid and the base to be selectively moved between the first and second positions. The base may include a first shell that defines at least a first outer portion of the base. The lid may include a second shell that defines at least a first outer portion of the lid. A first segment of the zipper may be joined to the first and second shells on inner facing surfaces of the first and second shells. The thicknesses of the first and second shells may be sufficiently large so that at least along the first segment of the zipper, a portion of the zipper is recessed relative to the outermost portions of the first and second shells that are proximate the zipper.

Still another embodiment of the luggage piece may include a base, a lid, and a zipper. The lid may be pivotally joined to the base to pivot between at least a first position where the base and the lid define a substantially enclosed space and a second position to allow access to the substantially enclosed space. The zipper may be configured in a first configuration to secure the lid and the base in the first position and in a second configuration to allow the lid and the base to be selectively moved between the first and second positions. The base may include a first outer member that defines at least an outer portion of the base. The lid may include a second outer member that defines at least an outer portion of the lid. A first support member may be joined to an inner facing surface of the first outer member. The first support member may be located between the first outer member and a segment of the zipper. A second support member may be joined to an inner facing surface of the second outer member. The second support member may be located between the second outer member and the segment of the zipper. A combined thickness of the first support member and the first outer member and a combined thickness of the second support member and the second outer member may both be sufficiently large so that along the segment of the zipper, a portion of the zipper is recessed relative to the outermost portions of the first and second outer members that are proximate to the zipper.

Another embodiment of a luggage piece may include a base, a lid, a zipper, and a carry handle. The lid may be pivotally joined to the base to pivot between at least a first position where the base and the lid define a substantially enclosed space and a second position to allow access to the substantially enclosed space. The zipper may be configurable in a first configuration to secure the lid and the base in the first position and in a second configuration to allow the lid and the base to be selectively moved between the first and second positions. The carry handle may be joined to the lid and the base.

Yet another embodiment of a luggage piece may include a base, a lid, and a carry handle. The lid may be pivotally joined to the base by a hinge to pivot between at least a first position where the base and the lid define a substantially enclosed space and a second position to allow access to the substantially enclosed space. The carry handle may be joined to the lid, the base, and the hinge.

A further embodiment of a luggage piece may include a base, a lid, and a carry handle. The lid may be pivotally joined to the base to pivot between at least a first position where the base and the lid define a substantially enclosed space and a second position to allow access to the substantially enclosed space. The carry handle may be joined to the lid and the base, and the carry handle may be positioned proximate abutting edges of the lid and the base.

DETAILED DESCRIPTION

Described herein are luggage pieces that incorporate at least one recessed zipper. Such a luggage piece may include a front side, a rear side, a top side, a bottom side, a right side and a left side that define an enclosed space. The enclosed space may be divided into one or more compartments. The luggage piece may further include at least one zipper to access the enclosed space. The at least one zipper may include a zipper track, at least one zipper slider, and at least one zipper tab. At least a portion of the zipper track may be positioned within one or more recessed areas defined by at least some of the sides of the luggage or may be otherwise configured relative to other components of the luggage piece to be at least partially recessed relative to an outer surface of the luggage piece. In some embodiments, the zipper track may be recessed relative to an outer surface of the luggage piece along substantially the entire length of the zipper track.

Figure 2:
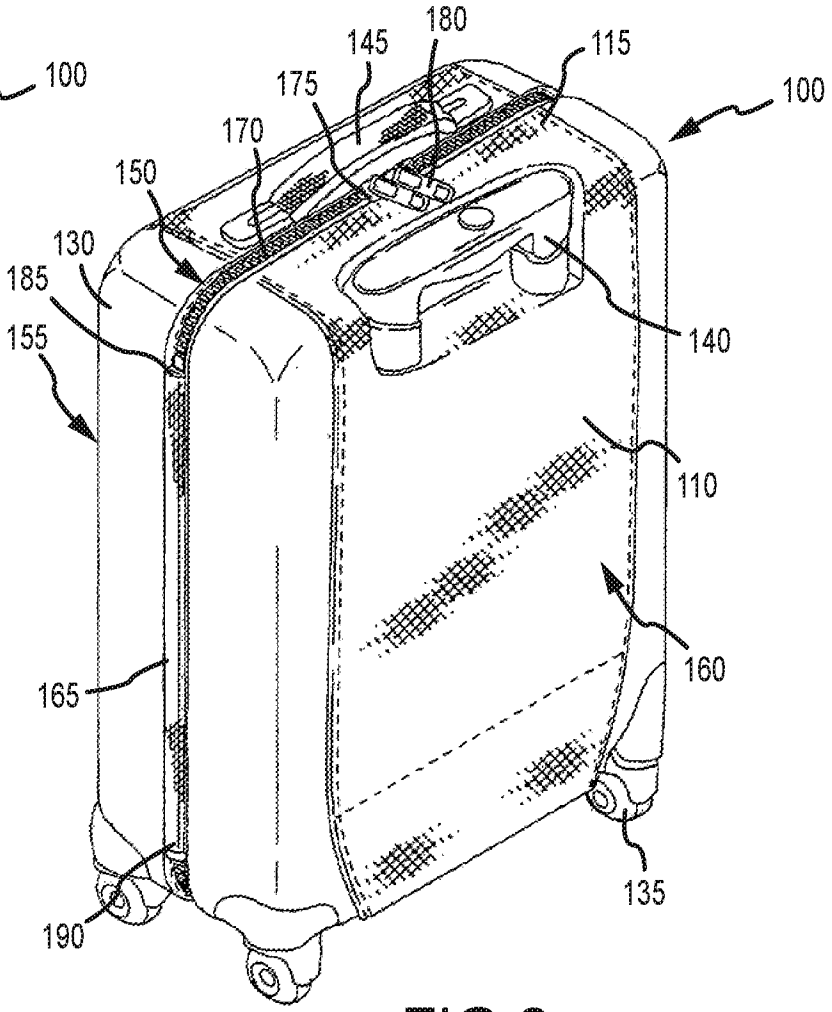
FIG. 2 shows another perspective view of the luggage piece shown in FIG. 1
Figure 1:
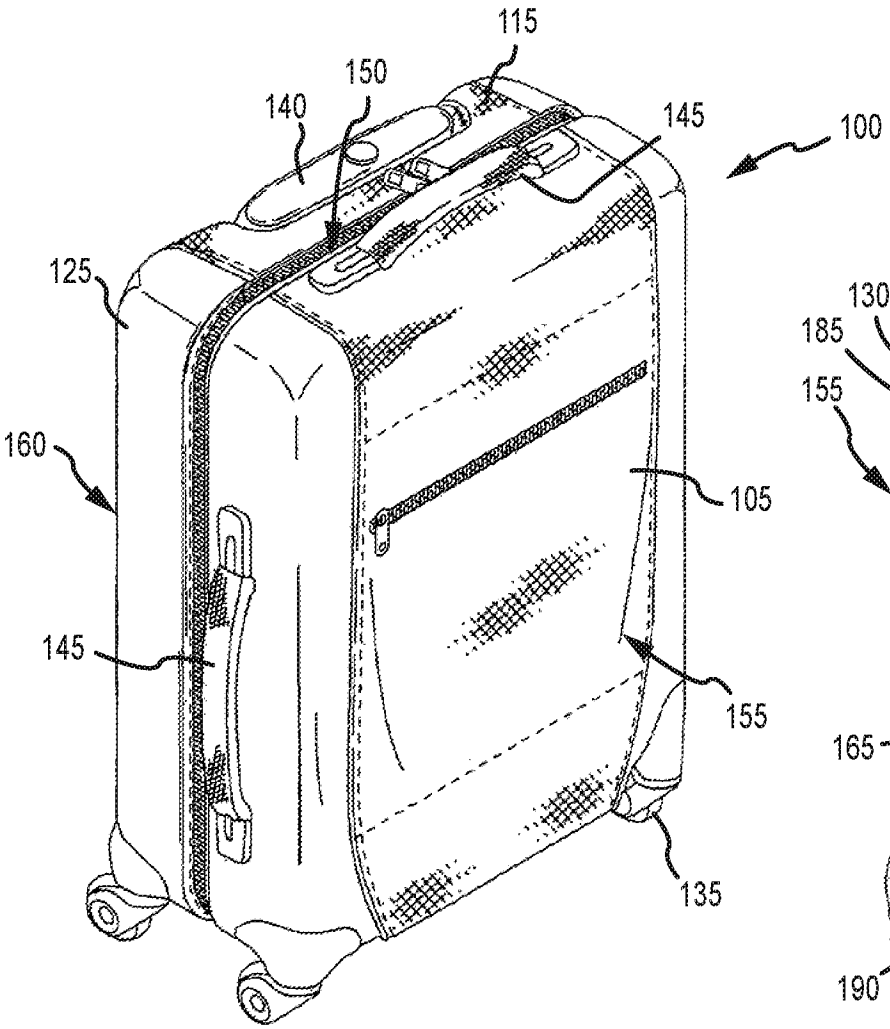
FIG. 1 shows a perspective view of an embodiment of a luggage piece that incorporates a recessed zipper.
Figure 4:
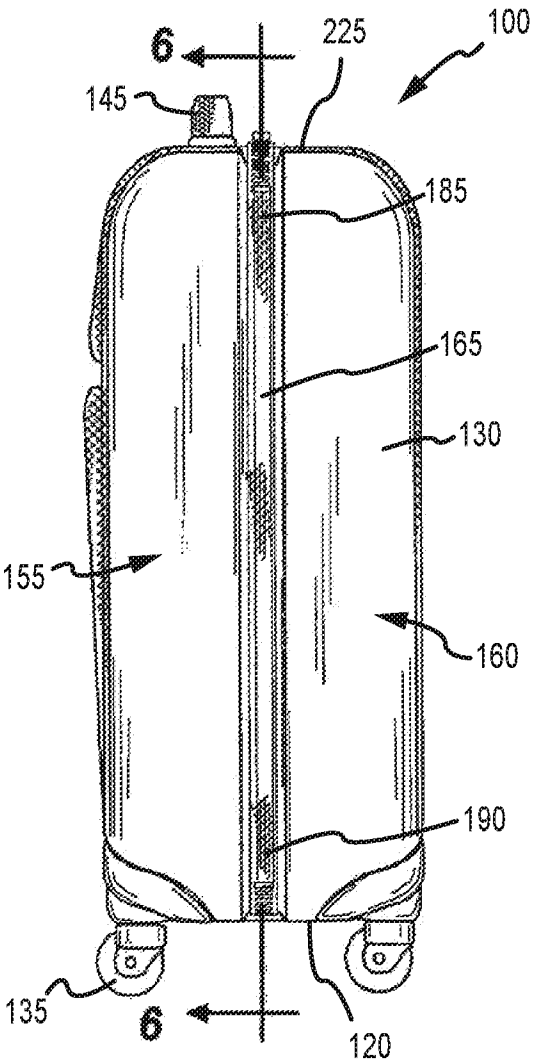
FIG. 4 shows a side elevation view of the luggage piece shown in FIG. 1.
Figure 3:
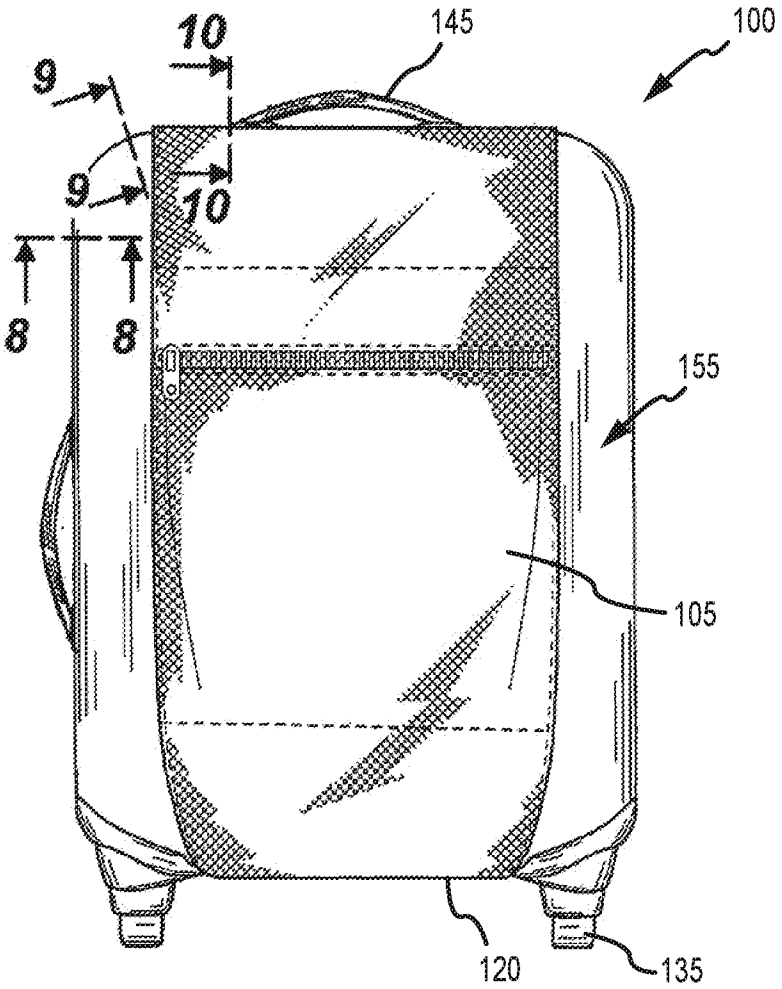
FIG. 3 shows a front elevation view of the luggage piece shown in FIG. 1.
Figure 5:
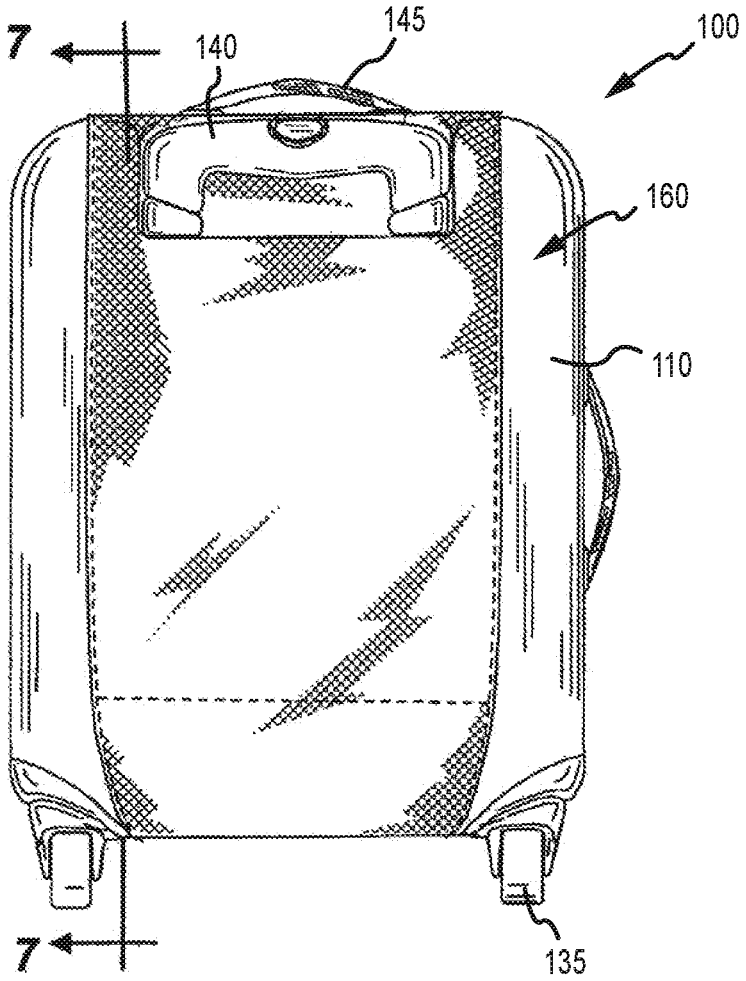
FIG. 5 shows a rear elevation view of the luggage piece shown in FIG. 1.
Figure 6:
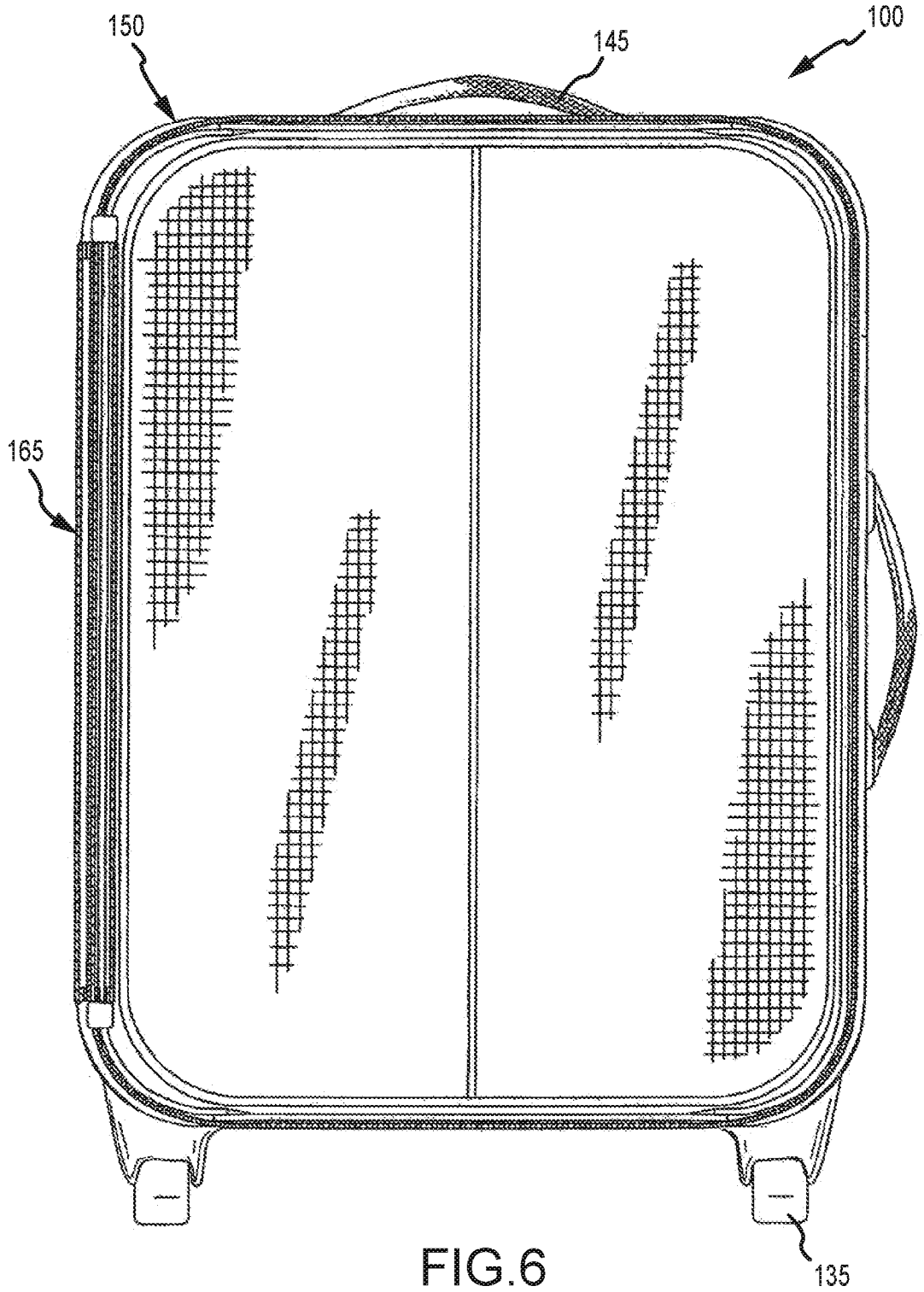
FIG. 6 shows a cross-section view of the luggage piece shown in FIG. 1, viewed along line 6-6 in FIG. 4.
Figure 7:
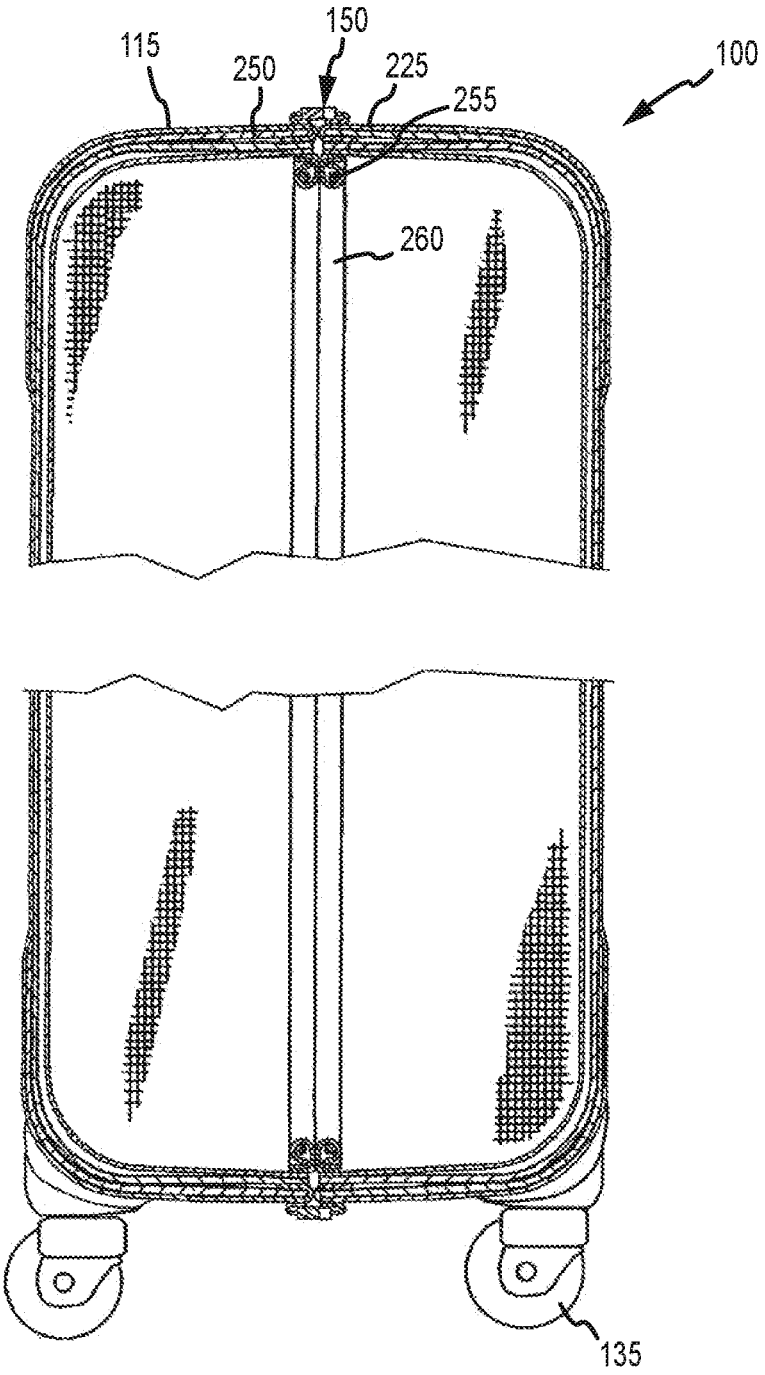
FIG. 7 shows a cross-section view of the luggage piece shown in FIG. 1, viewed along line 7-7 in FIG. 5.

FIG. 1 shows a front perspective view of one example of a luggage piece 100 that utilizes a recessed zipper, and FIG. 2 shows a rear perspective view of the luggage piece 100 shown in FIG. 1. With reference to FIGS. 1 and 2, the luggage piece 100 may include a front side 105, a rear side 110, a top side 115, a bottom side 120, a right side 125 and a left side 130 that define an enclosed space (not shown). The enclosed space may be divided into one or more compartments. The luggage piece 100 may further include one or more wheels 135 joined to the bottom side 120 of the luggage piece 100. The wheels 135 may be spinner wheels, as shown in FIG. 1, or fixed direction wheels. While four spinner wheels 135 are shown in the figures, the luggage piece 100 may have more or less than four wheels. In embodiments that use two wheels, one or more foots or other supports may be joined to the bottom side of the luggage piece to facilitate positioning and maintaining the luggage piece in an upright position, similar to the upright position for the luggage piece 100 shown in FIGS. 1 and 2.

The luggage piece 100 may further including one or more handles. At least one of the handles may be a telescoping handle 140 that may be selectively positioned between a retracted position and one or more extended positions. In an extended position, the telescoping handle 140 may be used to facilitate using the wheels 135 to push or pull the luggage piece 100 along a support surface. One or more of the handles may be carry handles 145. In FIG. 1, two carry handles 145 are shown: one joined to top side 115 of the luggage piece 100, and the other to the right side 125 of the luggage piece 100. The carry handles 145 may be used to lift or carrying the luggage piece 100. Of course, more or less than two carry handles 145 could be joined to the luggage piece 100.

The luggage piece 100 may further include a first zipper 150 that provides access to the enclosed space. More particularly, the front side 105 and portions of the right, left, top, and bottom sides 125, 130, 115, 120 of the luggage piece 100 may be joined to define a first luggage portion 155, or first shell portion, of the luggage piece 100 that can move in unison. Similarly, the rear side 110 and remaining portions of the right, left, top, and bottom sides 125, 130, 115, 120 of the luggage piece 100 may define a second luggage portion 160, or second shell portion, of the luggage piece 100 that move in unison. The first luggage portion 155 may also be referred to as a lid or base, and the second luggage portion 160 may be referred to as a base (when the first luggage portion 155 is considered to be lid) or lid (when the first luggage portion 155 is considered to be a base). The first and second luggage portions 155, 160 may be joined by a hinge 165 that allows them to be selectively pivoted relative to each other to different configurations while remaining joined via the hinge 165. In the configuration shown in FIG. 1, the first and second luggage portions 155, 160 collectively define the enclosed spaced. When pivoted to other positions where the abutting edges of first and second luggage portions 155, 160 are separated, the enclosed space may be accessed.

The first zipper 150 may be positioned along the abutting edges of the first and second luggage portions 155, 160. The first zipper 150 may include a zipper track 170, two zipper sliders 175, and two zipper tabs 180. Each zipper tab 180 may be joined to a respective zipper slider 175 to facilitate selectively moving its respective zipper slider 175 along the zipper track 170. The zipper track 170 may be positioned along the abutting edges of the first and second luggage portions 155, 160 from at least one end portion of the hinge 165 to the distal end portion of the hinge 165. For example, the zipper track 170 may extend from at least an upper end portion 185 of the hinge 165 to the top side 115 of the luggage piece 100, along the top side 115 of the luggage piece 100 to the right side 125 of the luggage piece 100, along the right side 125 of the luggage piece 100 to the bottom side 120 of the luggage piece 100, along the bottom side 120 of the luggage piece 100 to the left side 130 of the luggage piece 100, and along the left side 130 of the luggage piece 100 to at least a lower end portion 190 of the hinge 165.

Figure 8:
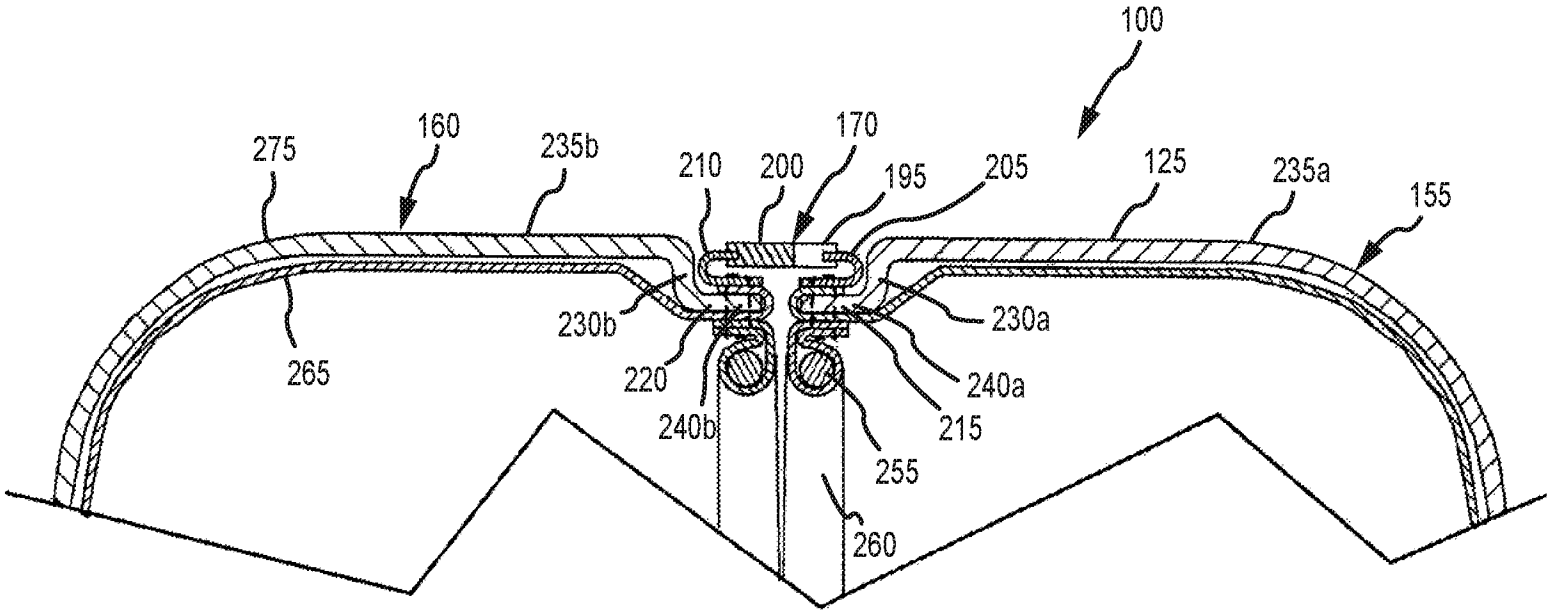
FIG. 8 shows a partial cross-section view of the luggage piece shown in FIG. 1, viewed along line 8-8 in FIG. 3.
Figure 9:
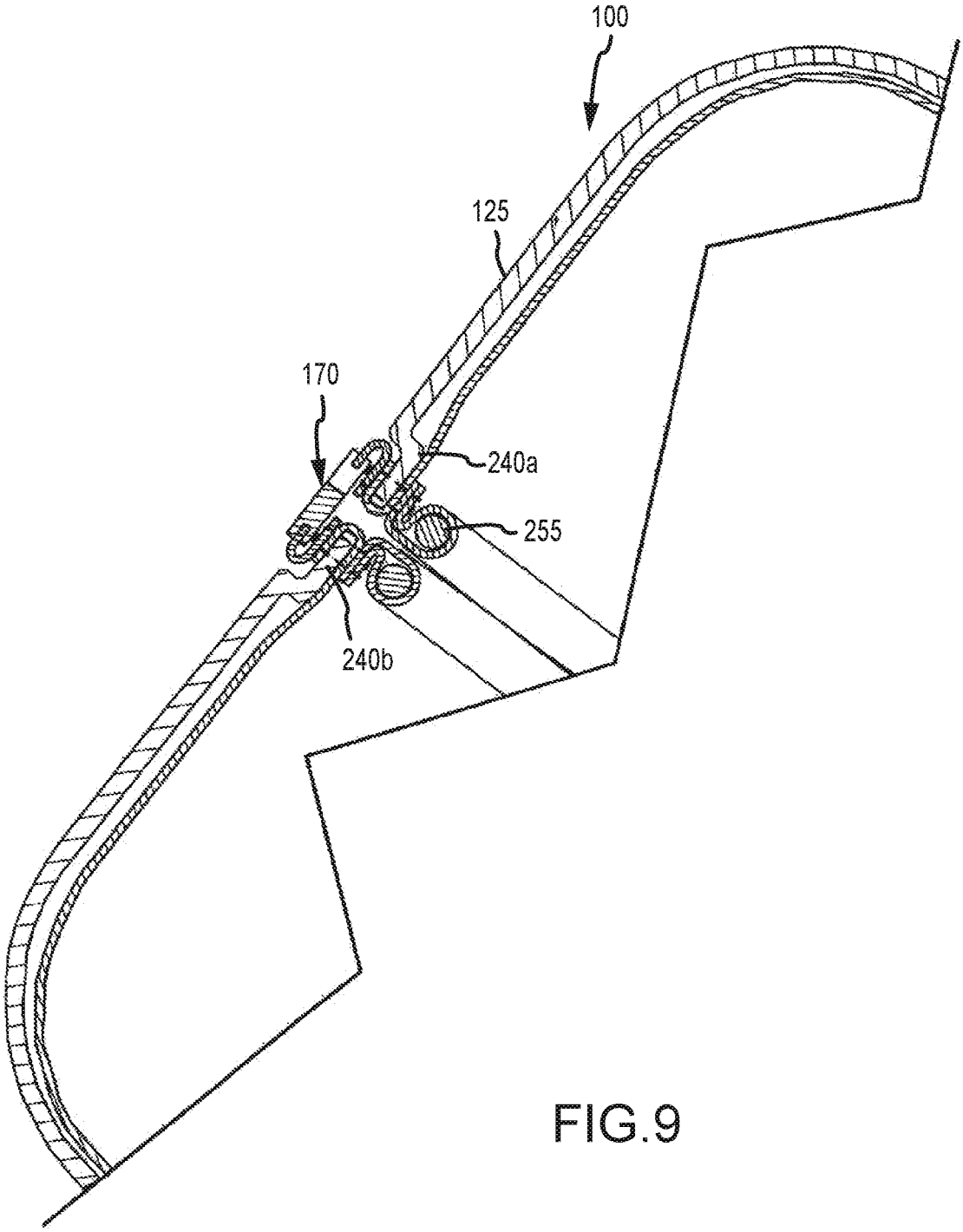
FIG. 9 shows a partial cross-section view of the luggage piece shown in FIG. 1, viewed along line 9-9 in FIG. 3.
Figure 10:
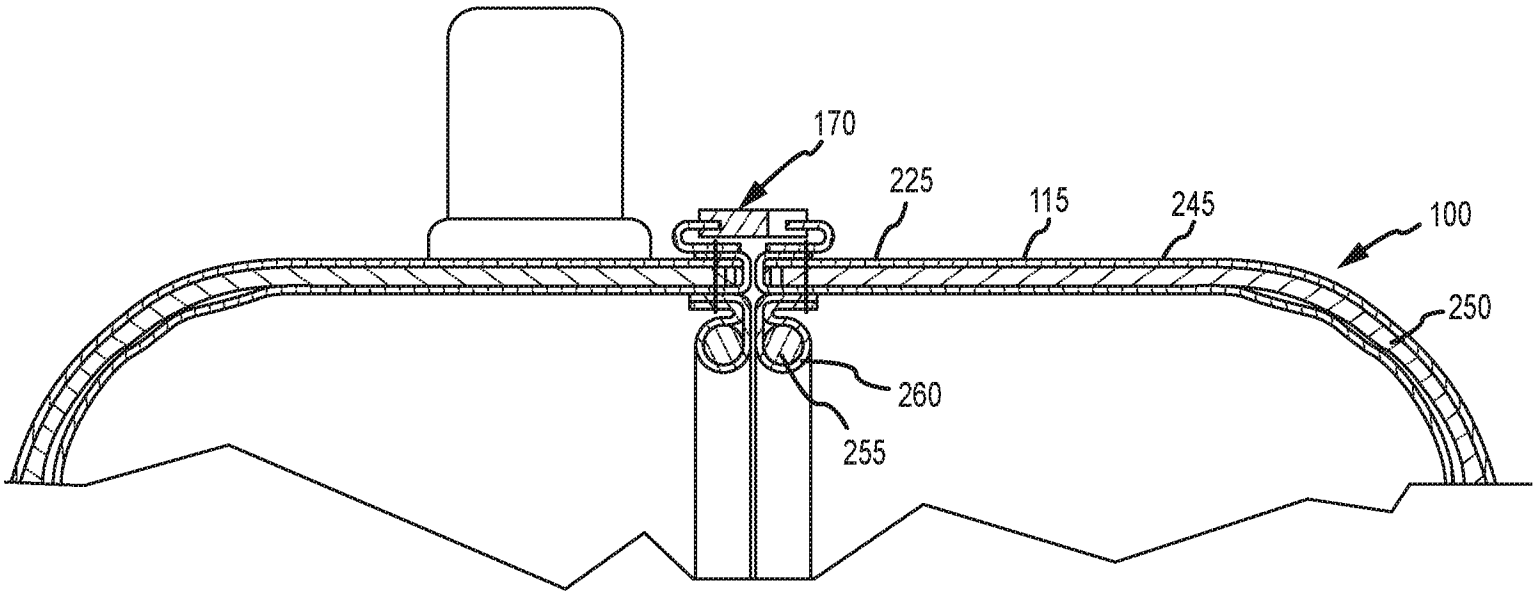
FIG. 10 shows a partial cross-section view of the luggage piece shown in FIG. 1, viewed along line 10-10 in FIG. 3.
Figure 11:
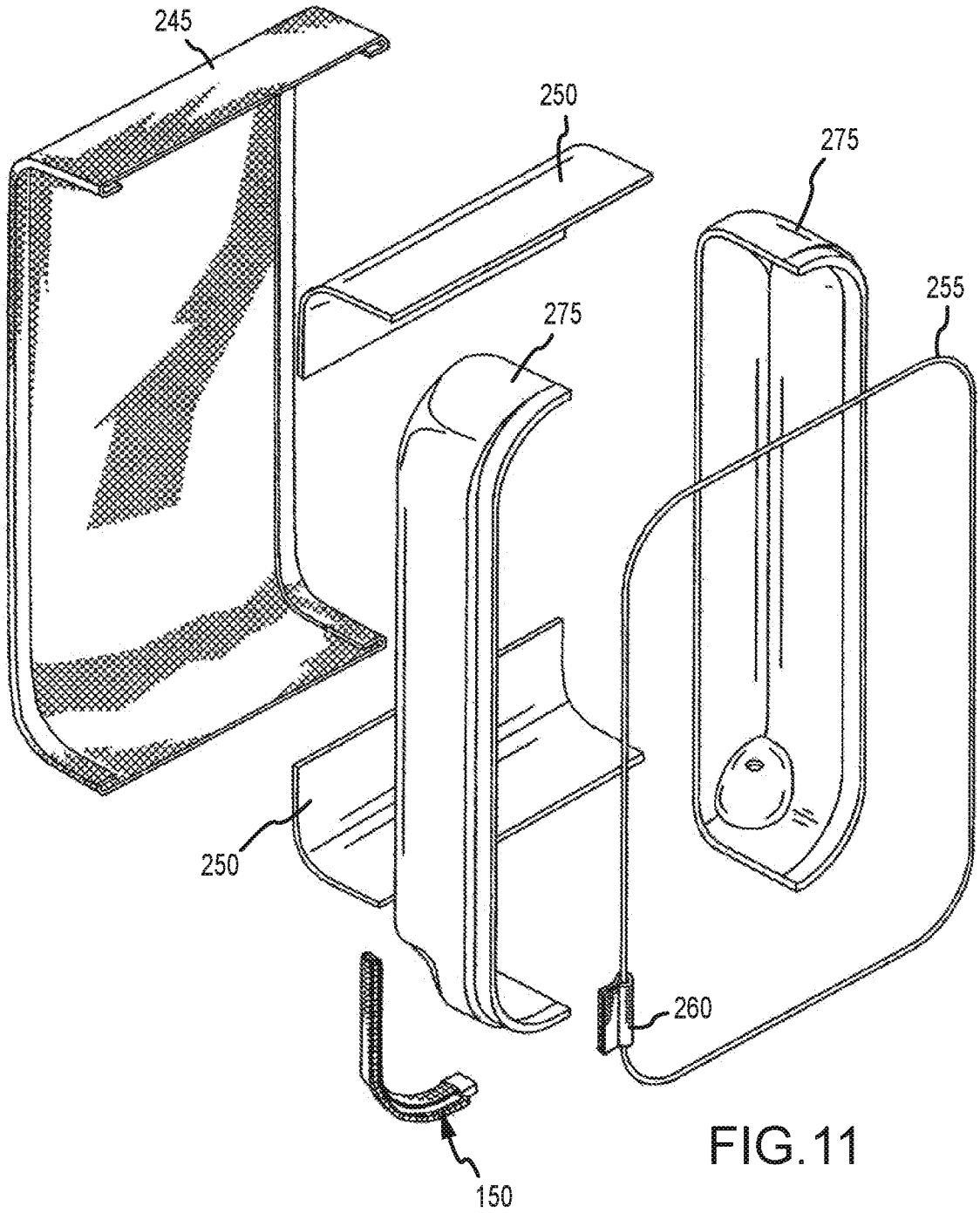
FIG. 11 shows an exploded view of some of the components that form the luggage piece shown in FIG. 1.

With reference to FIG. 8, the zipper track 170 may include a first set of teeth 195 joined to a first zipper tape 205 and a second set of teeth 200 joined to a second zipper tape 210. The first set of teeth 195 may be joined to the edge 215 of the first luggage portion 155 that abuts the second luggage portion 160, and the second set of teeth 200 may be joined to the edge 220 of the second luggage portion 160 that abuts the first luggage portion 155. The first and second sets of teeth 195, 200 may be joined to the first and second luggage portions 155, 160, respectively, by any suitable connection method, including, but not limited to, by sewing, bonding, adhering, welding, and so on.

The teeth of first set of teeth 195 may be configured to selectively engage corresponding teeth on the second set of teeth 200. Selectively moving the zipper sliders 175 along the zipper track 170 causes the teeth of the first and second sets of teeth 195, 200 to be selectively engaged and disengaged. When one or both of the zipper sliders 175 are moved away from each other, at least some of the teeth in the first and second sets of teeth 195, 200 are disengaged, thus creating an opening in the zipper track 170. When a sufficient number of teeth in the first and second sets of teeth 195, 200 are disengaged, the opening is sufficiently large to allow access to the enclosed space defined by the first and second luggage portions 155, 160. When the teeth of the first and second sets of teeth 195, 200 along substantially the entire length of the zipper track 170 are disengaged, the first luggage portion 155 may be selectively pivoted relative to the second luggage portion 160, or vice versa. Similarly, when a substantial majority of the teeth of the first and second sets of teeth 195, 200 are engaged, the first and second luggage portions 155, 160 cannot be selectively pivoted relative to each other.

While two zipper sliders 175 are shown in the various figures to open and close the luggage piece 100, the first zipper 150 may only include one zipper slider 175. When the first zipper 150 includes a single zipper slider 175, moving the zipper slider 175 in one direction engages the teeth of the first and second sets of teeth 195, 200 and moving the zipper slider 175 in the opposite direction disengages the teeth. Thus, when the single zipper slider 175 is positioned at one end of the zipper track 170, substantially all of the teeth in the first and second sets of teeth 195, 200 are disengaged, and when the single zipper slider 175 is positioned at the other end of the zipper track 170, substantially all of the teeth for the first and second sets of teeth 195, 200 are engaged. In other respects, the first zipper 150 with a single zipper slider 175 operates in a similar manner as a first zipper 150 with two zipper sliders 175. Specifically, when all teeth of the first and second sets of teeth 195, 200 are engaged, access to the enclosed space is prevented. When a sufficient number of teeth of the first and second sets of teeth 195, 200 are disengaged, the enclosed space may be accessed. When substantially all of the teeth of the first and second sets of teeth 195, 200 are disengaged, the first and second luggage portions 155, 160 may be selectively pivoted relative to each other.

With reference to FIGS. 1-3, 6-10, and 12-15, at least a portion of the zipper track 170 may be recessed relative to the outer surfaces of the first and second luggage portions 155, 160. In some embodiments, the zipper track 170 may be recessed along one or more portions or segments of the zipper track's length. In other embodiments, the zipper track 170 may be recessed along the entire length of the zipper track 170.

FIGS. 1-15 show various embodiments of the luggage piece 100 in which the zipper track 170 is recessed along only portions or segments of the zipper track's length. With reference to FIGS. 1, 2 and 8, the zipper track 170 may be recessed along the right and left sides 125, 130 of the luggage piece 100 by positioning the zipper track 170 within recessed areas defined by the right and left sides 125, 130 of the luggage piece 100. With reference to FIGS. 8-10 and 12-15, as the zipper track 170 transitions from the right side 125 to the top side 115 of the luggage piece 100, the recessed area defined by the outer facing surface of the luggage piece 100 tapers. This tapering continues until at top side 115 of the luggage piece 100, the outer facing surface of the luggage piece 100 ceases to define a recessed area. Near this location, the zipper track 170 may be positioned at or near the outermost surface 225 of the top side 115 of the luggage piece 100. The zipper track 170 may be maintained at this position relative to the outermost surface 225 of the top side 115 of the luggage piece 100 until the zipper track 170 nears the left side 130 of the luggage piece 100. As the zipper track 170 approaches the left side 130 of the luggage piece 100, outer facing surface of the top side 115 of the luggage piece 100 begins to taper inward to define a recessed area relative to the outermost surface 225 of the top side 115. This tapering continues until the full depth of the recessed area is defined along the left side 130 of the luggage piece 100. A similar tapering of the recessed area occurs proximate the transition from the right and left sides 125, 130 of the luggage piece 100 to the bottom side 120 of the luggage piece 100. Further, as with the positioning of the zipper track 170 on the top side 115 of the luggage piece 100, at least a portion or segment of the zipper track 170 on the bottom side 120 of the luggage piece 100 may positioned at or near the outermost surface of the bottom side 120 of the luggage piece 100.

For embodiments where only portions or segments of the zipper track 170 are recessed relative to the outermost surfaces of the sides 105, 110, 115, 120, 125, 130 of the luggage piece 100, the location of the change from the recessed to the non-recessed portions, or segments, may depend, at least in part, on how the luggage piece 100 is constructed. For example, the luggage piece 100 shown in FIGS. 1-15 depicts a hybrid construction that includes components of a relatively rigid, semi-rigid, hard, or semi-hard material (collectively "harder material") and a relatively soft or non-rigid material (collectively "softer material"). Specifically, the right and left sides 125, 130 of the luggage piece 100 along with portions of the front, rear, top, and bottom sides 105, 110, 115, 120 of the luggage piece 100 adjacent the right and left sides 125, 130 may be formed using a harder material, such as acrylonitrile-butadiene-styrene ("ABS") plastic, polycarbonate plastic, an ABS/polycarbonate plastic blend, and so on. The harder areas may define four corner columns or supports for the luggage piece 100. The remaining or central portions of the front, rear, top, and bottom sides 105, 110, 115, 120 may be formed using a softer material, such as fabric or the like. In these softer regions, one or more support members, such as curved polypropylene ("PP") or polyethylene ("PE") sheets, may be provided at the top and bottom sides 115, 120 of the luggage piece 100 to help to maintain the shape of the luggage piece 100 in these regions.

While the harder areas are shown as vertical columns, these areas could be formed as horizontal columns positioned at the top and bottom sides 115, 120 of the luggage piece 100. In such a configuration, the harder areas would generally include the top and bottom sides 115 120 of the luggage piece 100 along with portions of the front rear, right, and left sides 105, 110, 125, 130 of the luggage piece 100. Like the vertical column embodiment, the remaining portions of the front, rear, right, and left sides 105, 110, 125, 130 may be formed using a relatively soft or pliable material, with support material also provided, as needed.

The harder and softer materials forming the sides 105, 110, 115, 120, 125, 130 of the luggage piece 100 may be joined by any suitable method, including, but not limited to, by stitching, bonding, welding or adhering the materials at their abutting edges. Proximate, or at the location, of the transition from the harder region to the softer region, the recess relative to the outermost surfaces of the sides 105, 110, 115, 120, 125, 130 may end so that at, or near, this transition, the zipper track 170 ceases to be recessed relative to the outermost surfaces of the sides 105, 110, 115, 120, 125, 130 of the luggage piece 100.

With continued reference to FIG. 8, the zipper track 170 may be recessed along the right side 125 of the luggage piece 100 by defining a recessed area within the right side 125 of the luggage piece 100. Specifically, the right side 125 of the luggage piece 100 may be formed to define a pair of recessed area sidewalls 230*a-b* that extend from the outermost surfaces 235*a-b* of the right side 125 of the luggage piece 100 toward the enclosed space defined by the first and second luggage portions 155, 160. For reference purposes, the end portion of the recessed area sidewalls 230*a-b* proximate respective outermost surfaces 235*a-b* of the right side 125 of the luggage piece 100 may be referred to herein as the outer recessed area sidewall end portion, and the end portion of the sidewall distal this outer sidewall end portion may be referred to herein as the inner recessed area sidewall end portion.

One of the recessed area sidewalls 230*a* may be positioned on the first luggage portion 155, and the other recessed area sidewall 230*b* may be positioned on the second luggage portion 160. Each recessed area sidewall 230*a-b* may extend transversely, or approximately transversely, from its respective outermost surfaces 235*a-b* on the first and second luggage portions 155, 160. If desired, either of the recessed area sidewalls 230*a-b* may extend away from its respective outermost surface 235*a-b* at an angle. Each recessed area sidewall 230*a-b* may be spaced apart from the other recessed sidewall 230*a-b* at least a sufficient distance along the lengths of the recessed area sidewalls 230*a-b* to accommodate the width of the zipper track 170. Further, the outer facing surface of each recessed area sidewall 230*a-b* may be generally parallel to the outer facing surface of the other recessed area sidewall 230*a-b* along the lengths of the recessed area sidewalls 230*a-b*.

A recessed area flange 240*a-b* may extend from each recessed area sidewall 230*a-b* proximate the inner recessed area sidewall end portion of its respective recessed area sidewall 230*a-b*. Each recessed area flange 240*a-b* may extend generally transversely, or approximately transversely, from its respective recessed area sidewall 230*a-b* towards the other recessed area sidewall 230*a-b*. Further, each recessed area flange 240*a-b* may end proximate the recessed area flange 240*a-b* extending from the other recessed area sidewall 230*a-b* such that the free ends of the recessed area flanges 240*a-b* abut each other.

The zipper track 170 may be joined to the recessed area flanges 240*a-b*. In particular, the first set of the teeth 195 for the zipper track 170 may be joined to one of the recessed area flanges 240*a*, and the second set of teeth 200 for the zipper track 170 may be joined to the other recessed area flange 240*b*. The first and second sets of teeth 195, 200 for the zipper track 170 may be joined by any suitable connection method, including, but not limited to, by stitching, bonding, fastening, welding, or adhering the first and second sets of zipper teeth 195, 200 to their respective flanges 240*a-b*. When joined to the recessed area flanges 240*a-b*, the location of the recessed area flanges 240*a-b* relative to the outermost surface 235 of the right side 125 of the luggage piece 100 defines the depth that the zipper track 170 is recessed relative to the outermost surface 235 of the right side 125 of the luggage piece 100. Further, this depth may be selected such that no portion of the zipper sliders 175 extend beyond the outermost surface 235 of the right side 125. In some embodiments, however, the depth may be designed such that at least a portion, usually an upper portion, of the zipper sliders 175 extend beyond the outermost surface 235 of the right side 125.

While the recessing of the zipper track 170 is described above with reference to the right side 125 of the luggage piece 100, a similar configuration could be used to recess the zipper track 170 on the top, bottom, and left sides 115, 120, 130. Further, the depth of the recessed area may be varied along the top, bottom, right or left sides 115, 120, 125, 130 and/or in the area where the luggage piece 100 transitions from the right and left sides 125, 130 to the top and bottom sides 115, 120. In one embodiment, the depth is varied by tapering the recessed area until the recessed area ceases to exist. Such a tapering may be linear or non-linear. Various means could be used to accomplish this tapering. In one embodiment, this tapering may be implemented by reducing the distance from the outer recessed area sidewall end portion to the inner recessed area sidewall end portion along the length of the recessed area sidewalls 230*a-b*. By reducing this distance, the distance of the recessed area flanges 240*a-b* from the outermost surface of a respective side 115, 120, 125, 130 is reduced, thus reducing the depth of the recessed area.

In other embodiments, the tapering of the recessed area may be accomplished by increasing the thickness of the recessed area flanges 240*a-b* along the lengths of their respective recessed area sidewalls 230*a-b* such the outer facing surface of the recessed area flanges 240*a-b* are positioned closer to the outermost surface of a respective side 115, 120, 125, 130 along the lengths of their respective recessed area sidewalls 230*a-b*. Since the outer facing surface of the recessed area flanges 240*a-b* defines the effective depth of the recessed area, positioning their outer facing surfaces closer to the outermost surface of a respective side 115, 120, 125, 130 along the lengths of their respective recessed area sidewalls 230*a-b* decreases the depth of the recessed area. A similar result could be achieved by maintaining the thickness of the recessed area flanges 240*a-b* while gradually changing the location of the recessed area flanges 240*a-b* from the inner recessed area sidewall end portion to the outer recessed area sidewall end portion of their respective recessed area sidewalls 230*a-b* along the lengths of the recessed area sidewalls 230*a-b*.

For non-recessed portions of the zipper track 170, the zipper track 170 may be joined to the luggage piece 100 proximate the outermost surface of the side 105, 110,115, 120, 125, 130 of luggage piece 100 where the non-recessed portion of the zipper track 170 is located. For example, with reference to FIGS. 7, 10, 12 and 15, the zipper track 170 on the top side 115 of the luggage piece 100 may be joined to an outer member 245, formed by a fabric or other suitable soft material, that defines the outermost surface 225 of the top side 115 of the luggage piece. To provide additional support for the first zipper 150 at these types of connections, a first support member 250, such as a sheet formed from polypropylene ("PP"), polyethylene ("PE"), or another suitable material, may be positioned under the outer member 245. Yet further, additional support may be provided by positioning a second support member 255, such as a wire or the like, under the first support member 250. To maintain the relative positions of the zipper track 170, the outer member 245, the first support member 250, and the second support member 255, these components may be joined together by stitching or any other suitable connection method. To facilitate stitching or otherwise joining the second support member 255 to the zipper track 170, the outer member 245, and the first support member 250, the second support member 255 may be wrapped in a cover 260 formed from a fabric material, a rubber material, a plastic material, or any other suitable material. The foregoing is merely one example of how the zipper track 170 in non-recessed portions or segment may be joined to an outermost surface of a side 105, 110, 115, 120, 125, 130 of the luggage piece 100. In other embodiments, the non-recessed portion of the zipper track 170 may be joined to a hard material, such as ABS plastic or the like. In such embodiments, the zipper track 170 may be joined directly to the either the outer facing surface or the inner facing surface of such materials by any suitable connection method, including, but not limited to, by stitching, bonding, adhering, and welding.

As described above, the second support member 255, such as a wire or the like, may be positioned under other components of the luggage piece 100 that support non-recessed portions or segments of the zipper track 170. The second support member 255 may also be positioned under components of the luggage piece 100 that are joined to the zipper track in recessed portions or segments of the zipper track 170. For example, with reference to FIGS. 8 and 9, the second support member 255 may be positioned under the recessed area flanges 240*a-b* of the luggage piece 100 that are joined to the zipper track 170. As another example, with reference to FIGS. 13 and 14, the second support member 255 may be positioned proximate the recessed area sidewalls 230*a-b* of the harder material that define the recessed areas. The second support member 255 may be stitched, or otherwise suitably joined, to the harder material and the recessed zipper track 170 to maintain the relative position of these components to each other. To facilitate stitching or otherwise joining the second support member 255 to the harder material, the second support member 255 may be wrapped in the cover 260.

Figure 12:
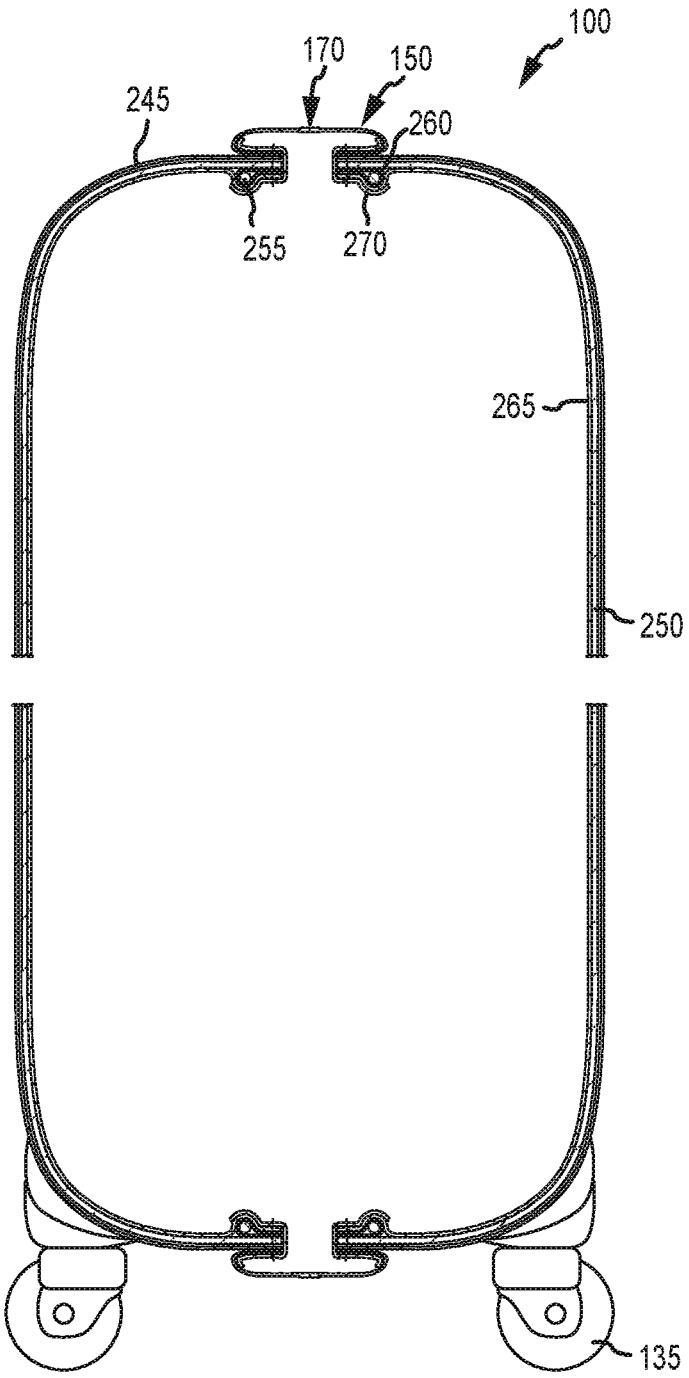
FIG. 12 shows a partial cross-section view of the luggage piece shown in FIG. 1 that is similar to the view shown in FIG. 7 except this view shows another way to join various components of the luggage piece together.
Figure 13:
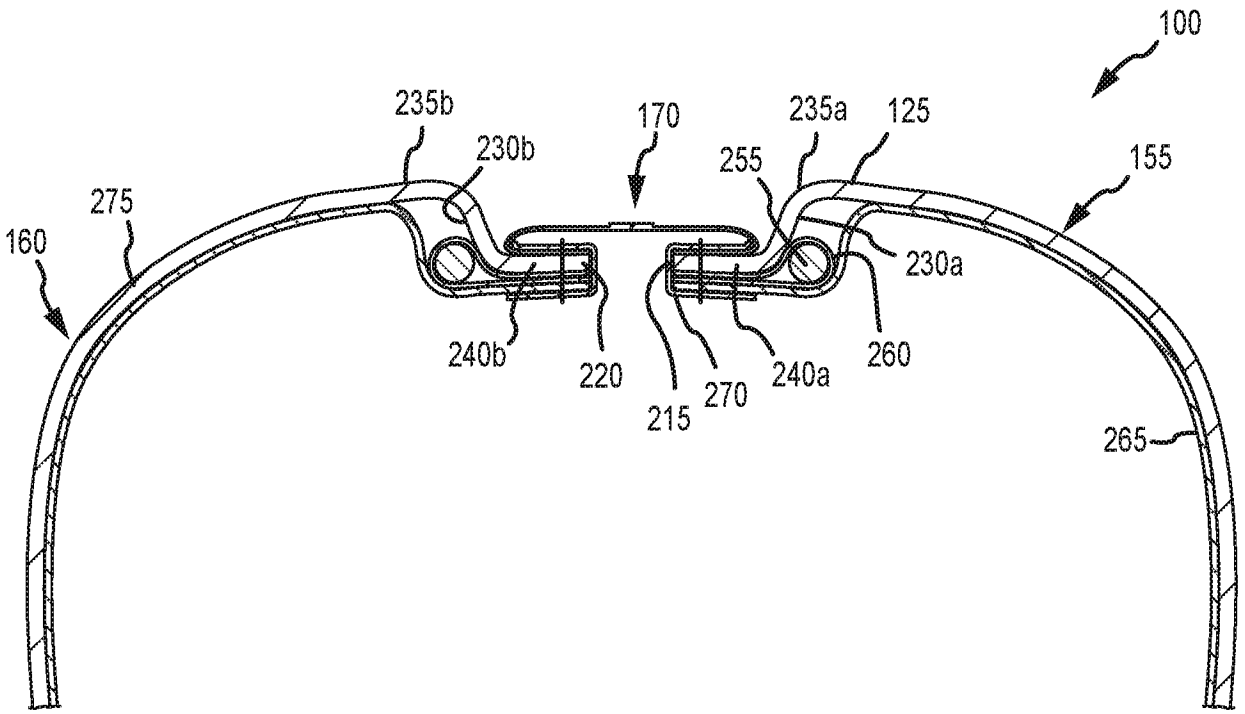
FIG. 13 shows a partial cross-section view of the luggage piece shown in FIG. 1 that is similar to the view shown in FIG. 8 except this view shows another way to join various components of the luggage piece together.
Figure 14:
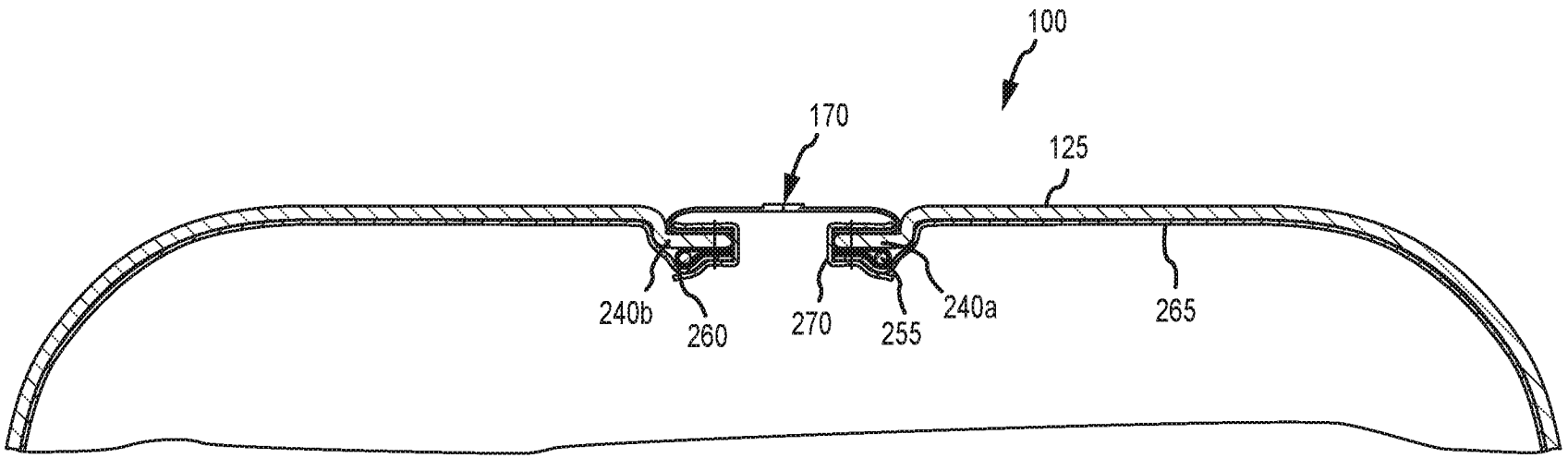
FIG. 14 shows a partial cross-section view of the luggage piece shown in FIG. 1 that is similar to the view shown in FIG. 9 except this view shows another way to join various components of the luggage piece together.
Figure 15:
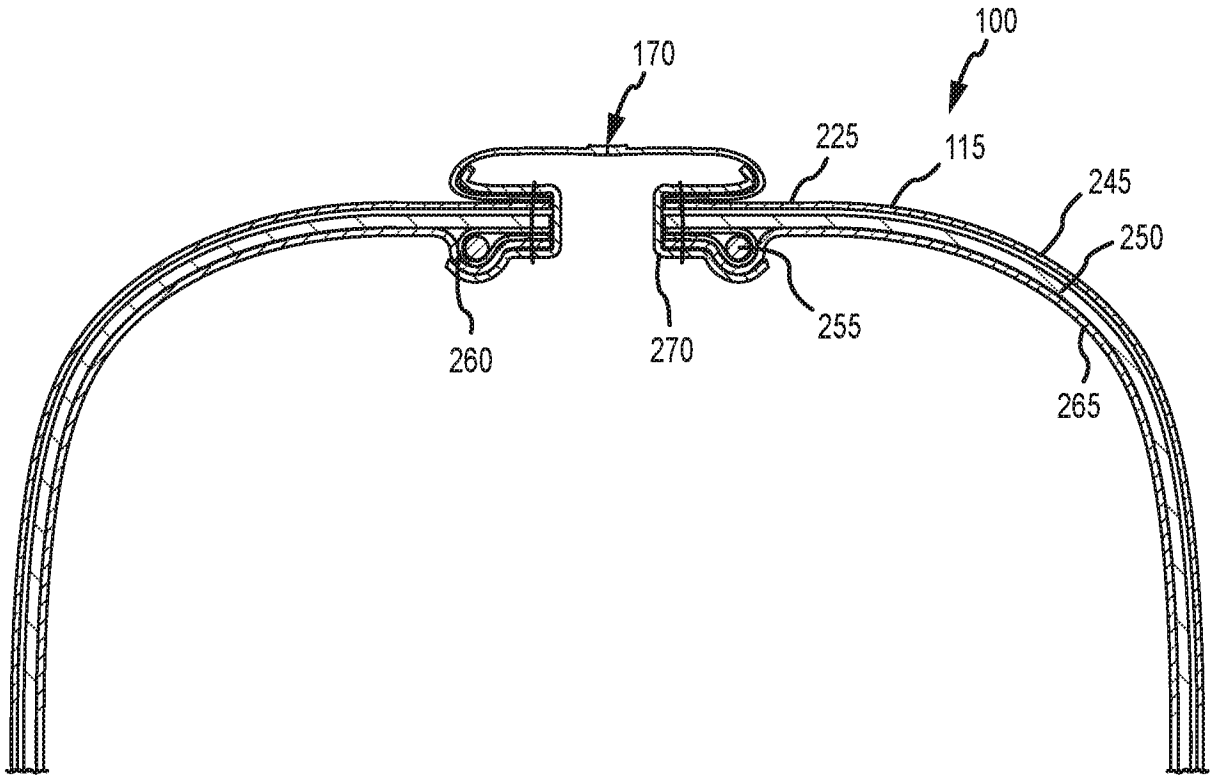
FIG. 15 shows a partial cross-section view of the luggage piece shown in FIG. 1 that is similar to the view shown in FIG. 10 except this view shows another way to join various components of the luggage piece together.
Figures 16A, 16B, 16C, 16D:
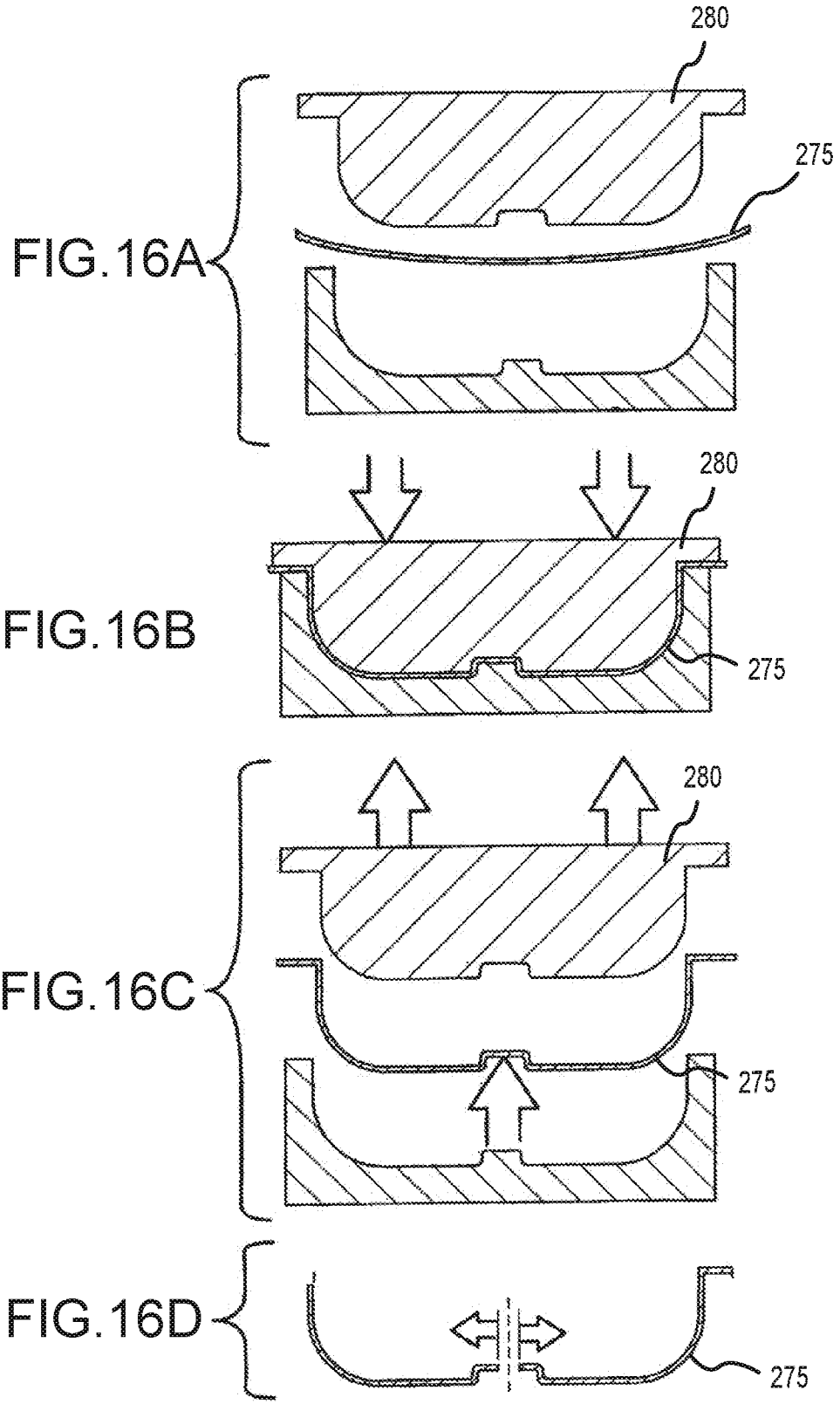
FIGS. 16A-D show schematic views of one method to form the corner supports for the luggage piece shown in FIG. 1.
Figure 19:
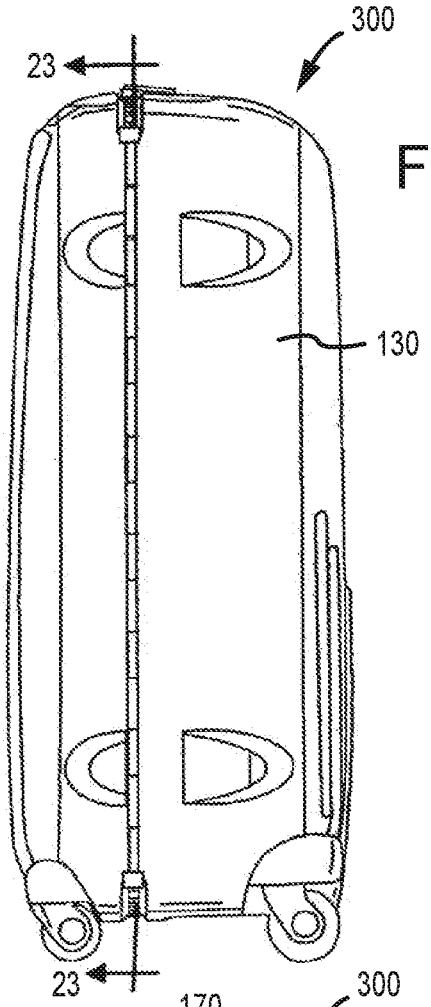
FIG. 19 shows a side view of the luggage piece shown in FIG. 17.
Figure 17:
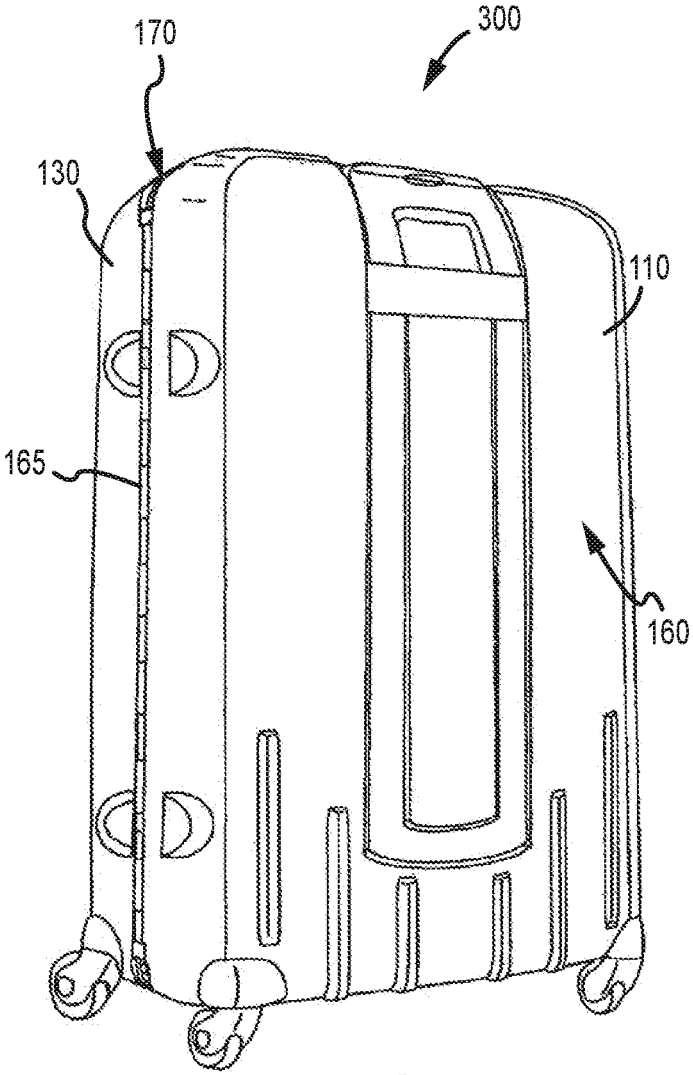
FIG. 17 shows a perspective view of a second embodiment of a luggage piece that incorporates a recessed zipper.
Figure 18:
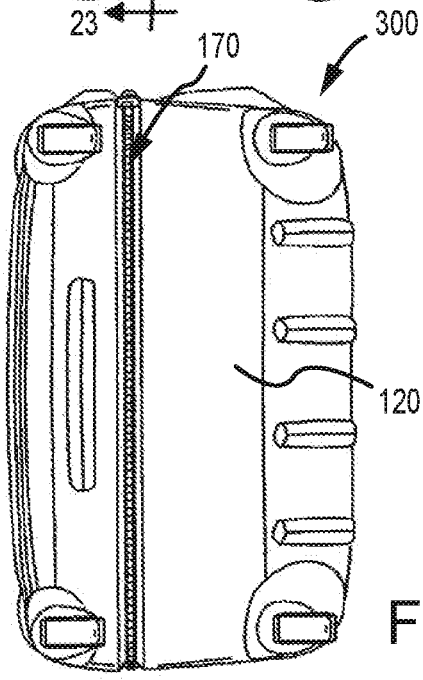
FIG. 18 shows a bottom view of the luggage piece shown in FIG. 17.
Figure 22:
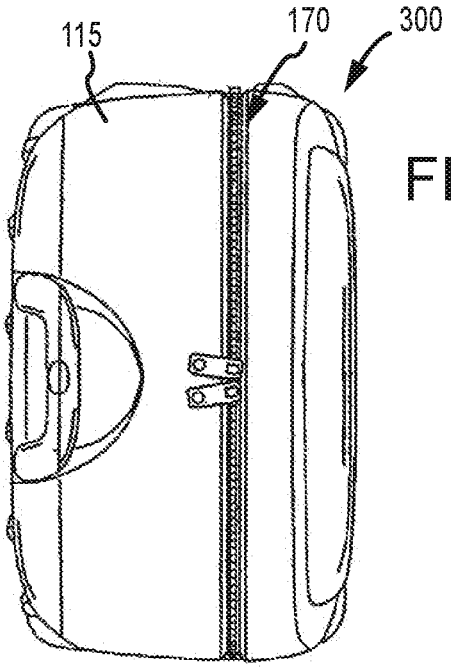
FIG. 22 shows a top view of the luggage piece shown in FIG. 17.
Figure 20:
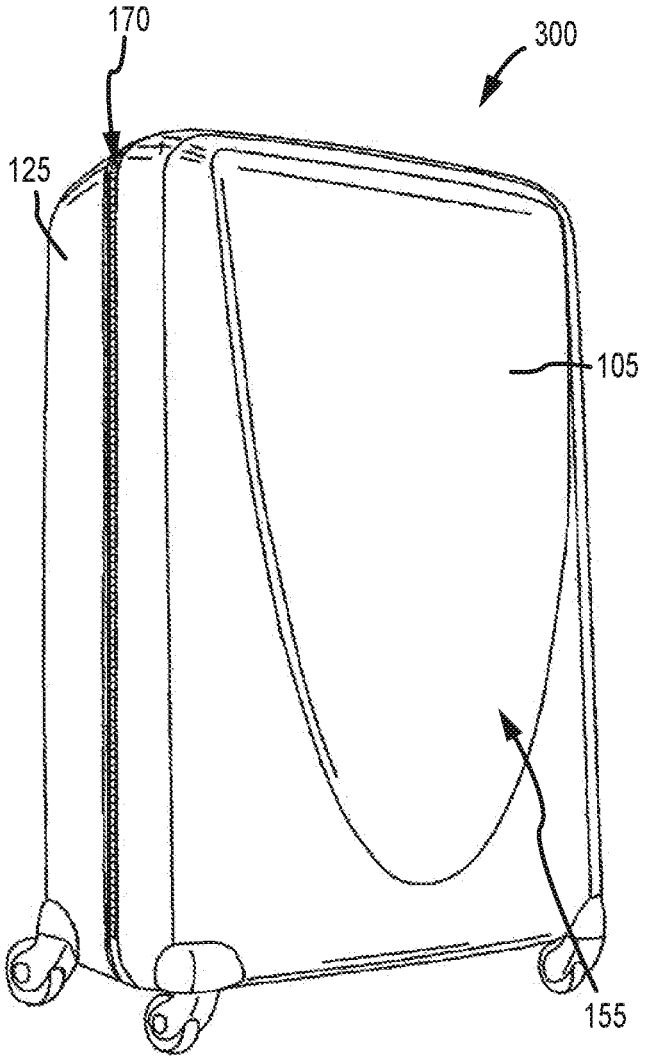
FIG. 20 shows another perspective view of the of the luggage piece shown in FIG. 17.
Figure 21:
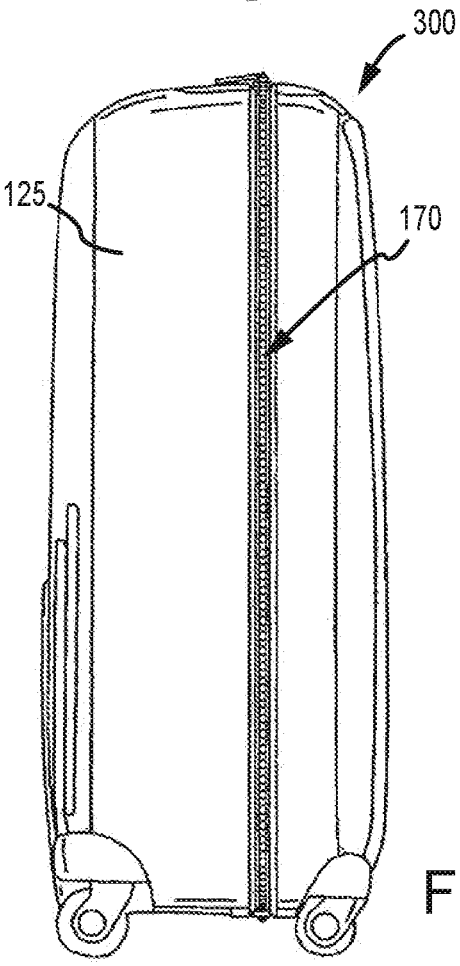
FIG. 21 shows another side view of the luggage piece shown in FIG. 17.
Figure 23:
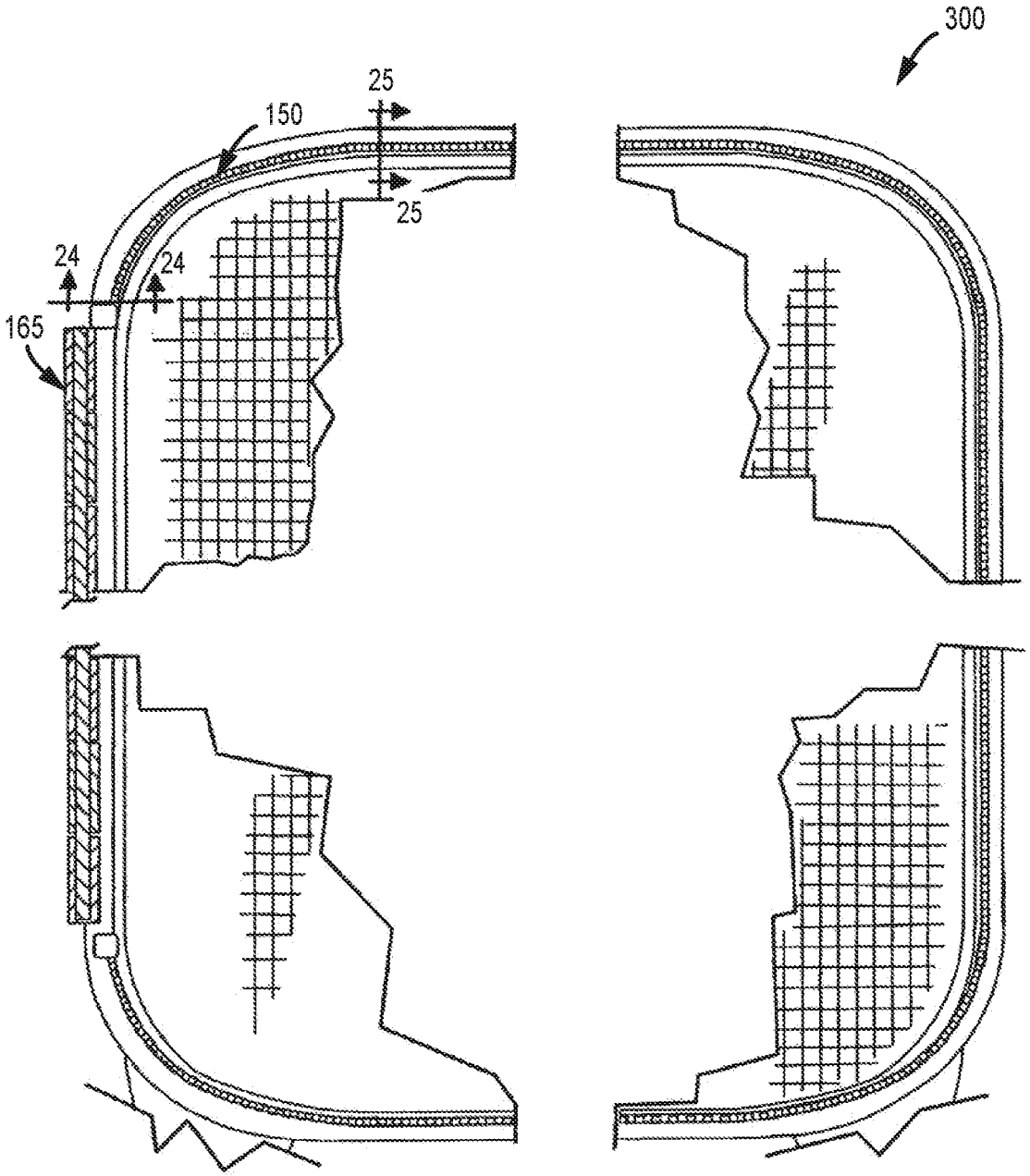
FIG. 23 shows a cross-section view of the luggage piece shown in FIG. 17, viewed along line 23-23 in FIG. 19.
Figure 24:
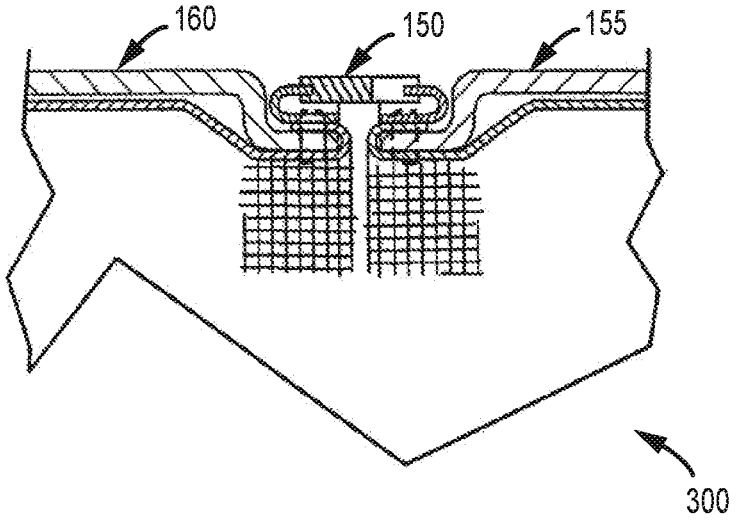
FIG. 24 shows a partial cross-section view of the luggage piece shown in FIG. 17, viewed along line 24-24 in FIG. 23.
Figure 25:
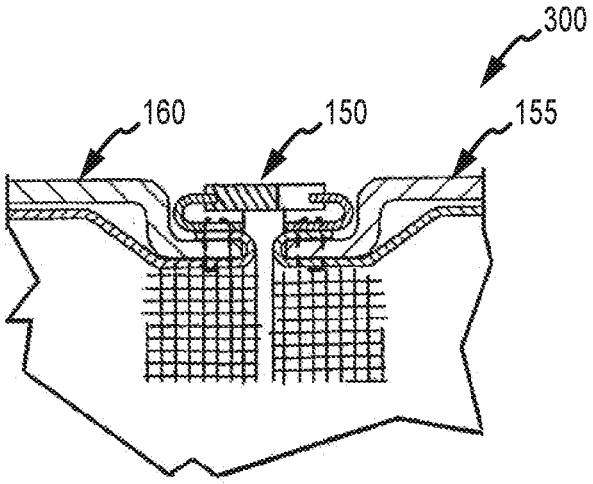
FIG. 25 shows a partial cross-section view of the luggage piece shown in FIG. 17, viewed along line 25-25 in FIG. 23.

With reference FIGS. 12 and 15, a lining 265 and a binding 270, each formed from a suitable fabric or other material, may also be joined to the zipper track 170, the outer member 245, the first support member 250, and the second support member 255. Similarly, with reference to FIGS. 13 and 14, the lining 265 and the binding 270 may also be joined to the zipper track 170 and the harder material. The lining 265 and the binding 270 may be used to enhance the feel and/or the visual look of the luggage piece.

The hinge 165 may be a fabric hinge, or any other suitable structure, that the joins the lid and the base in a hinged manner. The hinge 165 may be joined to the lid and the base by any suitable connection method, including, but not limited to, by stitching, adhering, bonding, or welding. In some embodiments, the hinge 165, like the first zipper 150, may be recessed relative to the outermost surface of the luggage piece.

The corner supports 275 for the luggage piece 100 may formed by a molding process. With reference to FIGS. 16A-D, the corner supports 275 may be formed in a press mold 280 that generally defines the shape for two adjacent corner supports 275 using a male and female mold sections. When the material used to form the corner supports 275 is removed from the press mold 280, the two adjacent corner supports 275 are joined together as shown in FIG. 12C. To separate them, the molded material may be cut along the centerline of the recessed area, as shown in FIG. 12D. When split, two of the four corner supports 275 are created for the luggage piece 100. The other two corner supports 275 may be formed using the same process. While the corner supports 275 are shown as being formed using a press mold 280, other types of molding, such as vacuum form molding may be used to form them.

FIGS. 17-25 show another embodiment of a luggage piece 300 with a recessed zipper, with like reference numbers used for elements of the second embodiment of the luggage piece 300 that are similar to elements of the first embodiment of the luggage piece 100. The luggage piece 300 is generally similar to the luggage piece shown in FIG. 1 except the zipper track 170 is recessed relative to the outermost surfaces of the sides 105, 110, 115, 120, 125, 130 of the luggage piece 300 along the length of the zipper track 170. Additionally, the luggage piece also differs from the luggage piece shown in FIG. 1 in that the lid 155, which may also be referred to as the first luggage portion, and the base 160, which may also be referred to as the second luggage portion, are each formed of harder material joined by a piano-type hinge 165. Like the harder corner supports in the first luggage, the lid 155 and the base 160 may be formed to define a recessed area where the first zipper 150 is joined to these components. As described above, the first zipper 150 may be sewn, or joined by any other suitable connection method, to the lid 155 and the base 160.

While the luggage piece 300 is described as being formed from a hard material, the luggage piece 300 could be formed using a hybrid construction (e.g., using harder materials, such as plastic, for a portion of the outer surface and softer materials, such as fabric, for the remaining outer surface) or a soft material construction. For the hybrid or soft constructions, the recessed areas for receiving the first zipper 150 may be formed by appropriately modifying support materials, such as the polypropylene or polyethylene sheets, to define the recessed areas. In other embodiments for hybrid or soft constructions, the first zipper 150 may be joined to the materials forming the lid 155 and the base 160 of the luggage piece 300 in such a manner that at least a portion of the first zipper 150 is recessed relative to the outermost surface of the sides of the luggage piece 300. Similarly, the luggage piece 100 described above in connection with FIGS. 1-15 could have exterior surfaces formed using either substantially all harder materials, such as plastic, or all softer materials, such as fabric. For luggage pieces 100 with exteriors constructed of harder materials, the harder materials could be molded or otherwise formed to define recessed and non-recessed areas for joining the first zipper 150 to the luggage piece 100, or the first zipper 150 may be joined to the components forming the lid 155 and the base 160 of the luggage piece 100 in such a manner that at least a portion of the first zipper 150 is recessed. Similarly, for softer material constructions, the support elements for the softer material and/or the softer material could be formed to define recessed and non-recessed areas, or the first zipper 150 may be joined to the components forming the lid 155 and the base 160 of the luggage piece 100 in such a manner that at least a portion of the first zipper 150 is recessed.

FIGS. 26-33 show a third embodiment of a luggage piece 400 with a recessed zipper, with like reference numbers used for elements of the second embodiment of the luggage piece 400 that are similar to elements of the first and second embodiments of the luggage piece 100, 300. The third embodiment is similar to the first and second embodiments in that at least a portion of the first zipper 150 is recessed relative to respective outermost surfaces of the sides 105, 110, 115, 120, 125, 130 of the luggage piece 400 along at least a portion of the zipper track 170. The third embodiment of the luggage piece 400 differs from the first and second embodiments in that the first zipper 150 is recessed based on how it is positioned relative to the other components that define the lid 155, which may also be referred to as the first luggage portion, and base 160, which may also be referred to as the second luggage portion, of the luggage piece 400 rather than recessed by positioning the first zipper 150 within a recessed area defined by the hard material. Further, unlike the first embodiment, at least a portion of the first zipper 150 is recessed within an area of the luggage piece 400 formed by the softer material.

Figure 26:
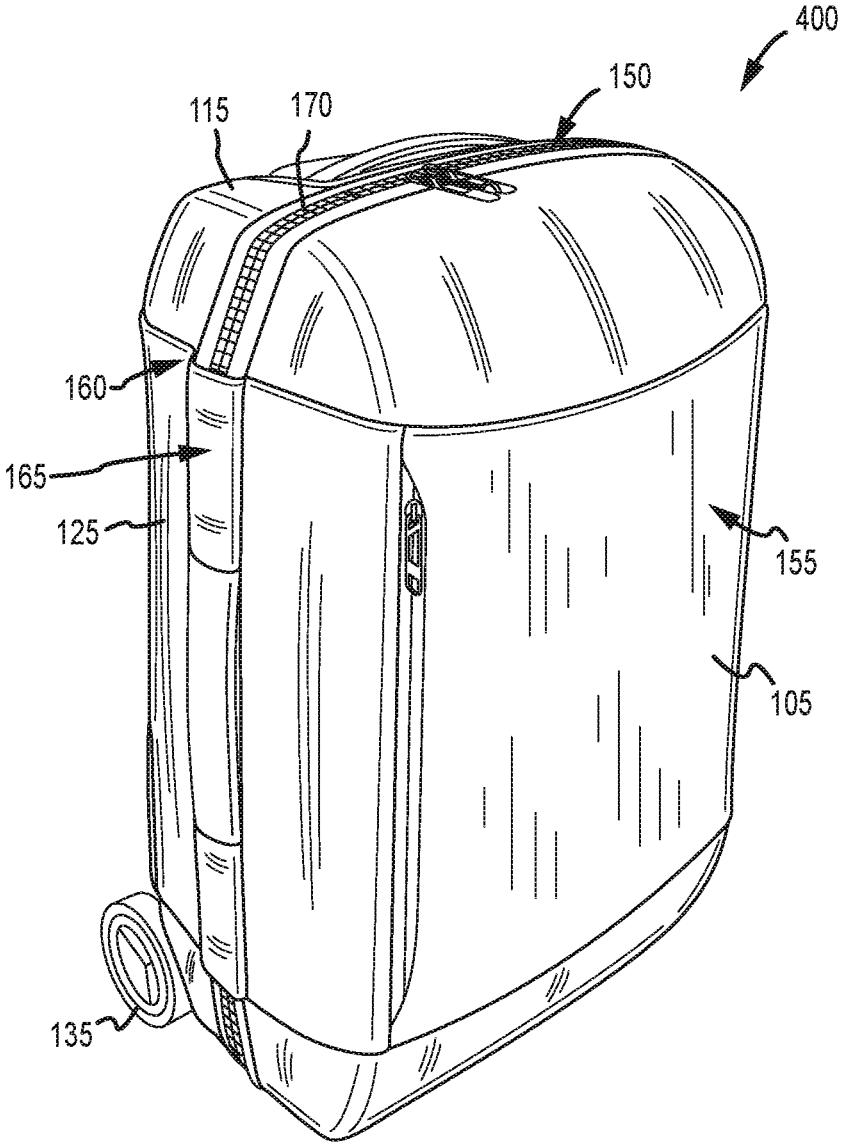
FIG. 26 shows a front perspective view of third embodiment of a luggage piece that incorporates a recessed zipper.
Figure 27:
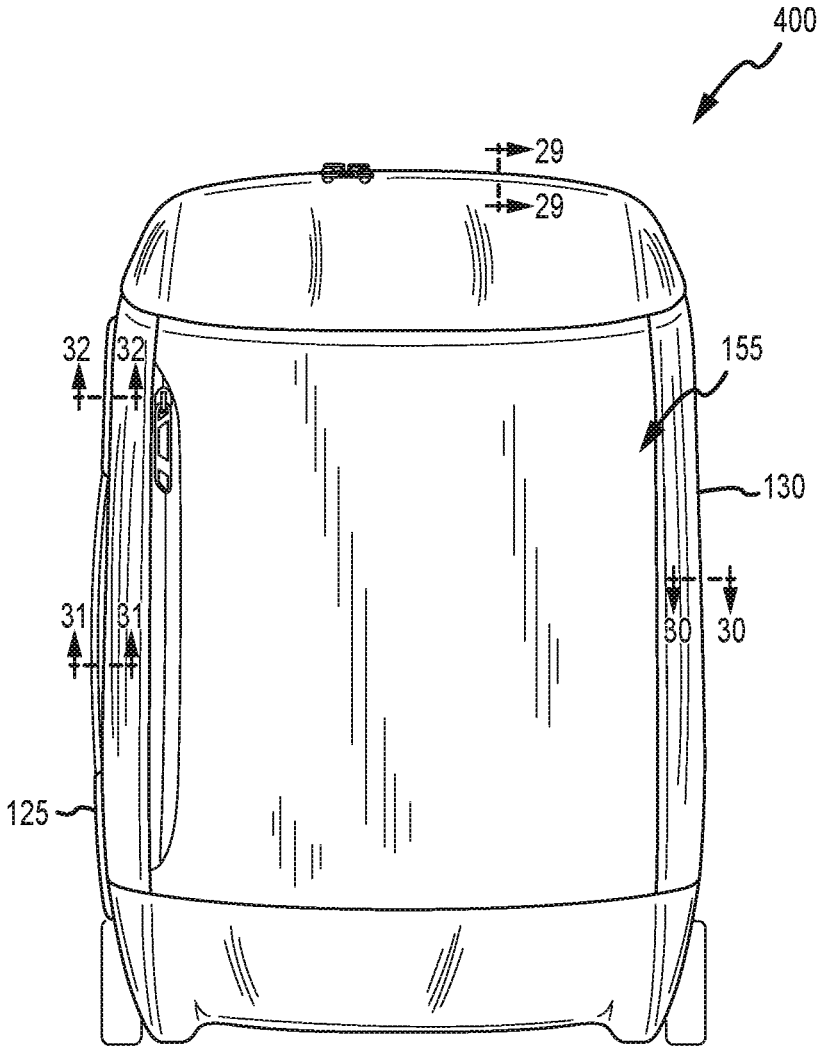
FIG. 27 shows a front elevation view of the luggage piece of FIG. 26.
Figure 28:
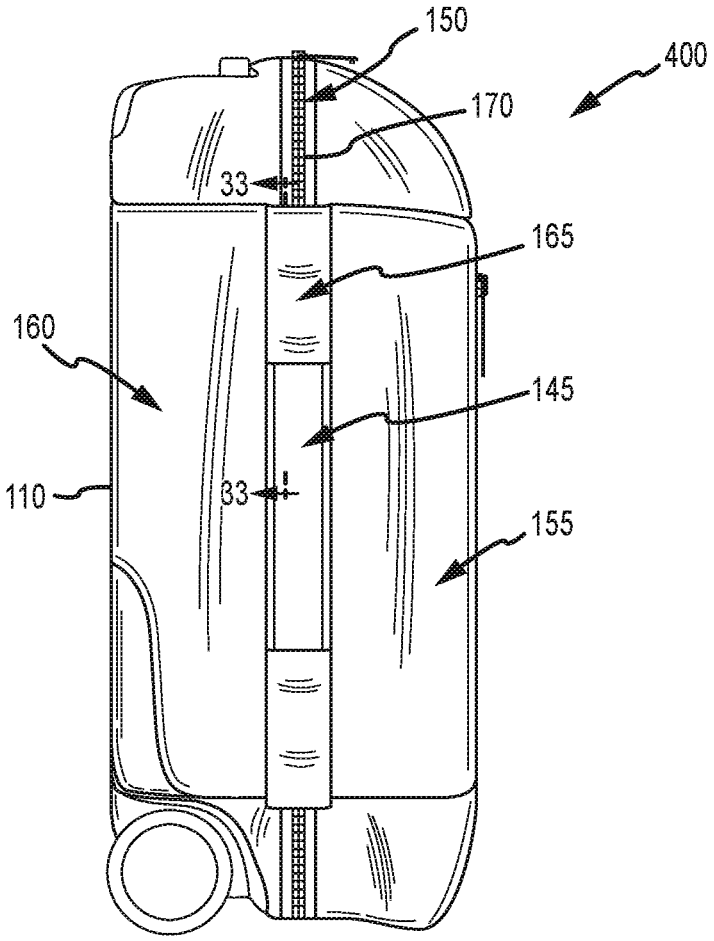
FIG. 28 shows a side elevation view of the luggage piece of FIG. 26.

In particular, with reference to FIGS. 26-28, the upper and lower portions of the third embodiment of the luggage piece 400 (i.e., the top and bottom sides 115, 120 of the luggage piece 400 along with portions of the front, rear, right, and left sides 105, 110, 125, 130 of the luggage piece 400 adjacent the top and bottom sides 115, 120) may be formed using a harder material, such as acrylonitrile-butadiene-styrene ("ABS") plastic, polycarbonate plastic, an ABS/polycarbonate plastic blend, and so on. The remaining or central portions of the front, rear, right, and left sides 105, 110, 125, 130 may be formed using a relatively soft or pliable material, such as fabric or the like. In these "softer" regions, first support members 405, such as ABS plastic sheets or strips, may be provided at the right and left sides 125, 130 of the luggage piece proximate the first zipper 150 to help to maintain the shape of the luggage piece 400 in these regions and to also facilitate recessing at least a portion of the first zipper 150 relative to the outermost surfaces of the rights and left sides 125, 130 of the luggage piece 400.

Figure 29:
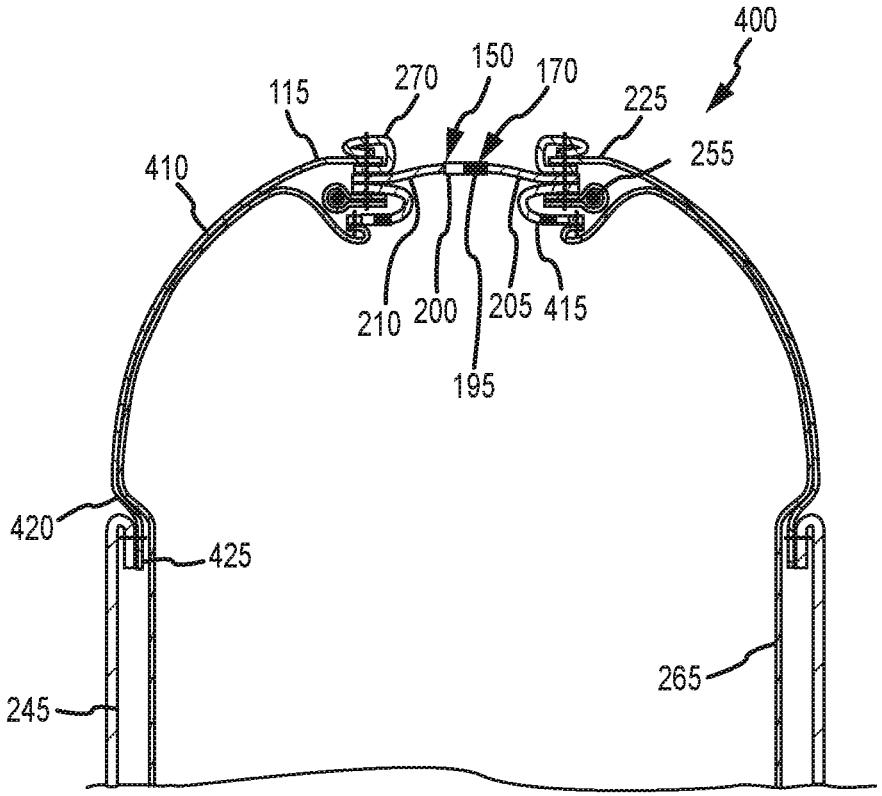
FIG. 29 shows a cross-section view of the luggage piece of FIG. 26, viewed along line 29-29 in FIG. 27.

Turning to FIG. 29, the harder materials defining the top and bottom portions of the luggage piece 400, which may also be referred to as upper and lower shells, may define the outer surface of the luggage piece 400 at these portions. In some embodiments, a softer material, such as an outer fabric or the like, may be joined to the outer facing surface of the upper and/or lower shells to enhance the look or the feel of the luggage piece 400.

With continued reference to FIG. 29, in contrast to the harder material in the first embodiment of the luggage piece 100, the upper shells 410 of the luggage piece 400 do not include a sidewall and a flange proximate the first zipper 150. Instead, a binding 270 may be joined by stitching or another suitable connection method to each upper shell 410 at a free end of the upper shell 410 where the zipper tape 205, 210 of the first zipper 150 are joined to the upper shells 410. Each zipper tape 205, 210 may then joined to an inner facing surface of one of the upper shells 410 by stitching or another suitable connection method. Because the zipper tape is joined to the inner facing surfaces of the upper shells 410, the first and second sets of zipper teeth 195, 200 of the first zipper 150 are positioned at approximately the same elevation as the inner surfaces of the upper shells 410. Thus, the zipper track 170 of the first zipper 150 is recessed relative to the outermost surface 225 of the top side 115 of the luggage piece 400, resulting in at least a portion of the first zipper 150 being recessed relative to the outermost surface 225 of the top side 115 of the luggage piece 400.

The portion of the first zipper 150 recessed relative to the outermost surface 225 of the top side 115 of the luggage piece 400 is a function of the thickness of the upper shells 410 and the thickness of the bindings 270. As the combined thickness of the upper shells 410 and the bindings 270 increases, the portion of the first zipper 150 that is recessed relative to the outermost surface 225 of the top side 115 of the luggage piece 400 increases. In some embodiments, the combined thickness of the upper shells 410 and bindings 270 is sufficiently large that the entire first zipper 150 is recessed relative to the outermost surface 225 of the top side 115 of the luggage piece 400. In other embodiments, the combined thickness of the upper shells 410 and bindings 270 may be selected so that a portion of the first zipper 150, usually an upper portion of the zipper slider 175, extends beyond the outermost surface 225 of the top side 115 of the luggage piece 400.

In some embodiments, the bindings 270 may be omitted. In such embodiments, the amount of recess of the first zipper 150 relative to the outermost surface 225 of the top side 115 of the luggage piece 400 would be a function solely of the thicknesses of the upper shells 410. In these embodiments, the entire first zipper 150, or a portion of the first zipper 150, may be recessed relative to the outermost surface 225 of the top side 115 of the luggage piece 400.

With continued reference to FIG. 29, like the first embodiment of the luggage piece, the third embodiment of the luggage piece 400 may include second support members 255, such as wires or the like, to provide additional structural support to the upper shells 410 proximate the first zipper 150. As in the first embodiment of the luggage piece 100, each second support member 255 for the third embodiment of the luggage piece 400 may be placed in a cover 260 formed from a fabric, rubber or other suitable material to facilitate stitching or otherwise joining the second support member 255 to the first zipper 150 and a respective upper shell 410.

The luggage piece 400 may further include interior zippers 415 that are positioned adjacent to the first zipper 150. Each interior zipper 415 may be joined to one of the second support member 255, the first zipper 150 and one of the upper shells 410 by stitching or another suitable connection method. Each interior zipper 415 may be used to selectively join and disconnect a lining 265 to one of the upper shells 410. In some embodiments, the interior zippers 415 may be omitted, and the lining 265 may be relatively permanently joined to a respective first zipper 150, second support member 255, and upper shell 410 by stitching or another suitable connection method.

Still referring to FIG. 29, each upper shell 410 may include a recessed area that is defined by a sidewall 420 and a flange 425 formed near a free end of the upper shell 410 that is the distal the free end that is joined to the first zipper 150. The outer member 245, which may formed from a fabric or other softer material, used in the softer areas of the luggage piece 400 may be joined by a suitable connection method (e.g., stitching) to an upper shell 410 proximate this recessed free end. By recessing the free end where the outer member 245 is joined to the upper shell 410, the outer surfaces of the outer member 245 and the upper shell 410 can be positioned within approximately the same plane at the location of transition between the outer surfaces of the upper shell 410 and the outer member 245. Such recessing of the upper shells 410 also allows the respective outer members 245 to be folded upon themselves where they are joined to the upper shell 410 without it being visible from the outside of the luggage piece 400 that the outer members 245 thicker in these regions than in other regions.

While the connection of the first zipper 150 and outer members 245 have been shown and described with reference to the upper shells 410 of the luggage piece 400, the first zipper 150 and outer member 245 may be joined to the lower shells of the luggage piece 400 in a similar manner. Further, the joining of the linings 265, interior zippers 415, and second support members 255, if any, to the lower shells may be done in a similar manner as described above and shown in FIG. 29 for the upper shells 410 of the luggage piece 400.

Figure 30:
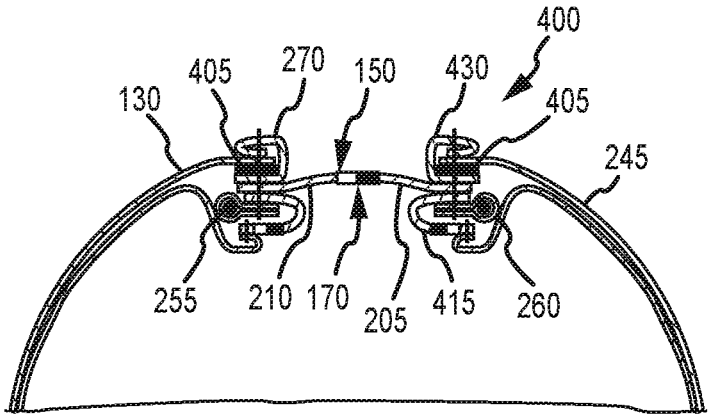
FIG. 30 shows a cross-section view of the luggage piece of FIG. 26, viewed along line 30-30 in FIG. 27.

With reference to FIG. 30, the first zipper 150 may also be recessed within the softer regions of the luggage piece 400. In these softer regions, the technique to recess the first zipper 150 is similar to the technique used in the harder regions except the upper and lower shells are replaced with the outer members 245, which define the outer surface of the luggage piece 400 in the softer regions, and first support members 405 that are positioned between the zipper tapes 205, 210 of the first zipper 150 and the inner surfaces of the outer members 245. Thus, in these softer regions, the recess of the first zipper 150 relative to the outermost surface 430 of left side 130 of the luggage piece 400 is a function of the thickness of the bindings 270, the outer members 245, and the first support members 405. As the combined thickness of the bindings 270, the outer members 245, and the first support members 405 increases, the portion of the first zipper 150 that is recessed relative to the outermost surface 430 of the left side 130 of the luggage piece 400 increases. In some embodiments, the combined thickness of the bindings 270, the outer members 245, and the first support members 405 is sufficiently large that the entire first zipper 150 is recessed relative to the outermost surface 430 of the left side 130 of the luggage piece 400. In other embodiments, the combined thickness of the bindings 270, the outer members 245, and the first support members 405 may be selected so that a portion of the first zipper 150, usually an upper portion of the zipper slider 170, extends beyond the outermost surface 430 of the left side 130 of the luggage piece 400.

In some embodiments, the bindings 270 and/or the first support members 405 may be omitted. In embodiments where only the bindings 270 are omitted, the amount of recess of the first zipper 150 would be a function of the thicknesses of the outer members 245 and the first support members 405. In embodiments where only the first support members 405 are omitted, the amount of recess of the first zipper 150 would be a function of the thickness of the outer members 245 and the bindings 270. In embodiments where both the bindings 270 and the first support members 405 are omitted, the amount of recess of the first zipper 150 would be a function of solely the thicknesses of the outer members 245. In any of these embodiments, the entire first zipper 150, or a portion of the first zipper 150, may be recessed relative to the outermost surface 430 of the left side 135 of the luggage piece 400.

The first support members 405 may take the form of ABS sheets, strips, or the like. Each first support member 405 may be an elongated strap or the like with the length of the strap running substantially parallel to the longitudinal axis of the zipper track 170. Further, each first support member 405 may run from an upper shell 410 to a lower shell. Each first support member 405 may have a generally rectangular cross-section along the length of the first support member 405. The rectangular cross-section advantageously creates relatively planar surfaces that abut the binding 270 and inner surface of the outer member 245. While the cross-section along the length of the first support member 405 is described and shown as being rectangular, any other desired cross-sectional shape, including trapezoidal or circular, may be used for the first support member 405.

Similar to the components used in the harder regions, one or more the following components may be joined to the outer members 245 and the first zipper 150 in the softer regions: second support members 255 to provide additional structural support, covers 260 to facilitate joining the second support members 255 to the other components, interior zippers 415 to selectively connect and disconnect linings 265 to the other components, and linings 265. As described above in connection with the harder region, these other components may be joined by any suitable method to the outer members 245 and the first zipper 150. Further, when present, the interior zippers 415 may be positioned next the first zipper 150, the first zipper 150 may be positioned next to the bindings 270, the bindings 270 may cover the free ends of the outer members 245 that are proximate the first zipper 150, and the first support members 405 may be positioned between the first zipper 150 and the inner surface of the outer members 245.

Figure 31:
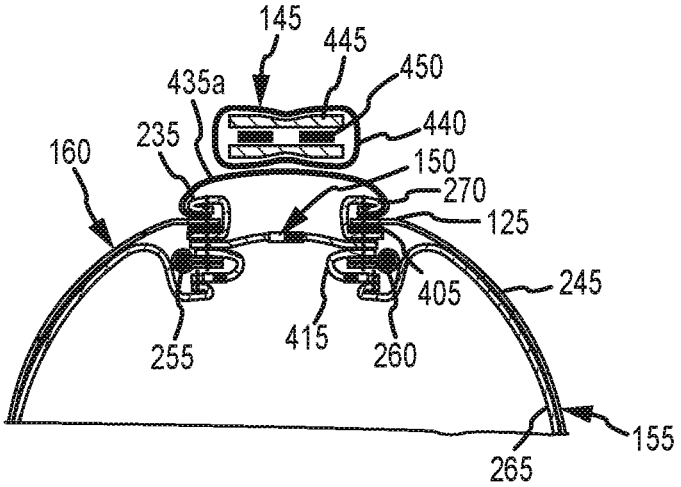
FIG. 31 shows a cross-section view of the luggage piece of FIG. 26, viewed along line 31-31 in FIG. 27.
Figure 32:
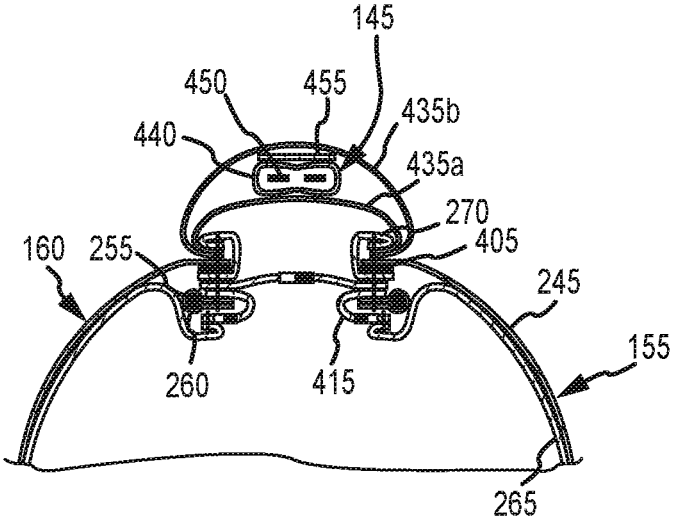
FIG. 32 shows a cross-section view of the luggage piece of FIG. 26, viewed along line 32-32 in FIG. 27.

Referring now to FIGS. 31 and 32, the first zipper 150 may also be recessed in the softer region on the right side 125 of the luggage piece 400. The first zipper 150 may be recessed in a manner similar to the method used in the softer region on the left side 130 of the luggage piece 400. More particularly, the first zipper 150 may be joined on the inner surfaces of the outer members 245 with bindings 270 and first support members 405 positioned between the first zipper 150 and the outer members 245. Further, the amount of recess of the first zipper 150 relative to the outermost surface 235 of right side 125 of the luggage piece 400 may be a function of the thicknesses of the outer members 245 and one or more of the thicknesses of the bindings 270 and the first support members 405. Additionally, to hinge together the lid 155 and the base 160 of the luggage piece 400, one or more hinge members 435*a-b* may be joined to the outer members 245 that define the outer surfaces of the base 160 and the lid 155 of the luggage piece 400 in the softer region. When one or more hinge members 435*a-b* are used, the amount of recess of the first zipper 150 may further be a function of the thicknesses of the hinge members 435 *a-b*. As with the left side 130 of the luggage piece 400 in the softer regions, the bindings 270 or the first support members 405 may be omitted.

With reference to FIGS. 28 and 31, proximate the middle portion of the luggage piece 400 on the right side 125 of the luggage piece 400, a first hinge member 435*a* may be used to join the lid 155 and the base 160. With reference to FIGS. 28 and 32, closer to the harder regions of the luggage piece 400, first and second hinge members 435*a-b* may be used to join the lid 155 to the base 160, with the second or outer hinge member 435*b* covering the first or inner hinge member 435*a*. The hinge members 435*a-b* allow the lid 155 and the base 160 of the luggage piece 400 to be selectively pivoted relative to each other while keeping the lid 155 and the base 160 joined together when the first zipper 150 is moved to a position where a substantial portion of the teeth of the first and second sets of teeth 195, 200 are disengaged. The hinge members 435*a-b* made be formed from a flexible fabric or any other suitable material. Further, the hinge members 435*a-b* may be sewn or to the outer members 245 or joined by any other suitable connection method.

Similar to left side 130 of the luggage piece 400 in the softer regions, one or more the following components may be joined to the outer members 245 and the first zipper 150 in the softer regions on the right side 125 of the luggage piece 400: second support members 255 to provide additional structural support, covers 260 to facilitate joining the second support members 255 to the other components, interior zippers 415 to selectively connect and disconnect linings 265 to the other components, and linings 265. As described above in connection with the harder region, these other components may be joined by any suitable method to the outer members 245 and the first zipper 150. Further, when present, the interior zippers 415 may be positioned next the first zipper 150, the first zipper 150 may be positioned next to the bindings 270, the bindings 270 may cover the free ends of the outer members 245 that are proximate the first zipper 150, and the first support members 405 may be positioned between the first zipper 150 and the inner surface of the outer members 245.

Returning back to FIG. 28, a carry handle 145 may be joined to the luggage piece 400 on the hinged side of the luggage piece 400 in the softer region. Further, the carry handle 145 may be positioned so it is located above the first zipper 150 and so that the length of the carry handle 145 runs parallel to the zipper track 170. Such positioning of the carry handle 145 over the first zipper 150 allows for the carry handle 145 to be positioned at approximately the center of the luggage piece 400 on the hinged side of the luggage piece 400 when the lid 155 and the base 160 are approximately the same size. Thus, a longitudinal axis of the carry handle 145 may be aligned with a centerline of the luggage piece 400. In some embodiments, the centerline of the luggage piece 400 may be a width centerline of the luggage piece 400. This may be beneficial in that it allows the carry handle 145 to be approximately aligned with the center or mass of the luggage piece 400 when the luggage piece 400 is moved using the carry handle 145.

Now turning back to FIGS. 31 and 32, the carry handle 145 may be positioned above the first hinge member 435*a* and below the second hinge member 435*b*. Thus, within the middle portion of the luggage piece 400 on the hinged side, the carry handle 145 may be exposed for grasping by the user, while closer to the harder regions of the luggage piece 400, the carry handle 145 may be covered by the second hinge members 435*b*. The carry handle 145 may include an outer handle member 440. The outer handle member 440 may be formed using a webbed fabric or other suitable material that is durable, elastic and/or flexible. The outer handle member 440 may be configured to define a tubular shape. The carry handle 145 may further include an inner handle member 445 that is positioned within the tubular cavity defined by the outer handle member 440. The inner handle member 445 may be a foam (e.g., EVA foam), a gel or another resilient and soft material and may be formed using two or more pieces of the material. The inner handle member 445 generally provides the user with more comfortable grip when carrying the luggage piece 400 using the carry handle 145.

Figure 33:
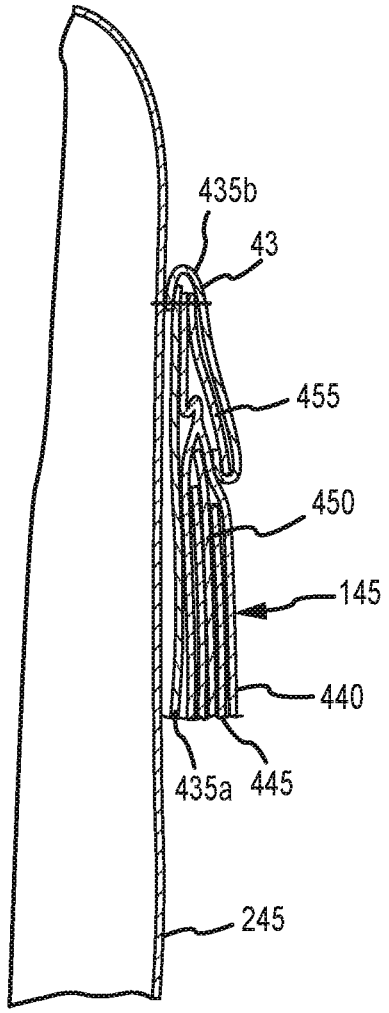
FIG. 33 shows a cross-section view of the luggage piece of FIG. 26, viewed along line 33-33 in FIG. 28.

With reference to FIGS. 31-33, the carry handle 145 may also include a biasing member 450 that is positioned with the tubular cavity defined by the outer handle member 440. The biasing member 450 may be configured to bias the carry handle 145 towards the outer surface of the luggage piece 400. The biasing member 450 may be one or more metal plates (e.g., steel plates) or other suitable structures that bias the carry handle 145 towards the outer surface of the luggage piece 400. Biasing the carry handle 145 towards the outer surface of the luggage piece 400 helps to reduce the dimensions of the luggage piece 400 when the carry handle 145 is not being used while allowing for the carry handle 145 to move away from the outer surface of the luggage piece 400 when grasped by a user in order to provide more space between the outer surface of the luggage piece 400 and the carry handle for the user's hands. The biasing member 450 may be positioned to be at least partially, up to fully, surrounded by the inner handle member 445. Such positioning of the biasing member 450 relative to the inner handle member 445 may reduce the ability of the user to feel the biasing member 450 within the outer handle member 440 and/or protect the user's hand from the biasing member 450.

To facilitate movement of the carry handle 145 away from the outer surface of luggage piece, excess material that forms the outer handle member 440 may be placed within a cavity defined by the first and second hinge members 435*a-b*. The excess material allows for the total length of the carry handle 145 that is exposed outside of the second hinge members 435*b* to be selectively increased and decreased. When increased, the amount of space between the outer surface of the luggage piece 400 and the inward facing surface of the carry handle 145 increases, thus providing more room for a user's hand. When decreased, the distance between the outer surface of the luggage piece 400 and the inward surface of the carry handle 145 decreases, thus bringing the carry handle 145 closer to the outer surface of the luggage piece 400. Further, because of the bias provided by the biasing member 450, when the carry handle 145 is released by the user, the biasing member 450 moves the carry handle 145 back towards the outer surface of the luggage piece 400.

With continued reference to FIG. 33, a rigid or semi-rigid handle support member 455 may be positioned within the cavity defined by the first and second hinge members 435*a-b*. The handle support member 455 may be positioned between the carry handle 145 and the second hinge member 435*b*. The handle support member 455 may be used to provide structural strength at the ends of the carry handle 145. The handle support member 455 may be made of a plastic material, such as polypropylene or polyethylene, or any other suitable material.

The carry handle 145 may be joined to the first and second hinge members 435*a-b* and the outer members 245 by stitching or any other suitable connection method. In particular, the end portions of the outer handle member 440 may be stitched or otherwise joined to the first and second hinge members 435*a-b* and the outer members 245.

Figure 34:
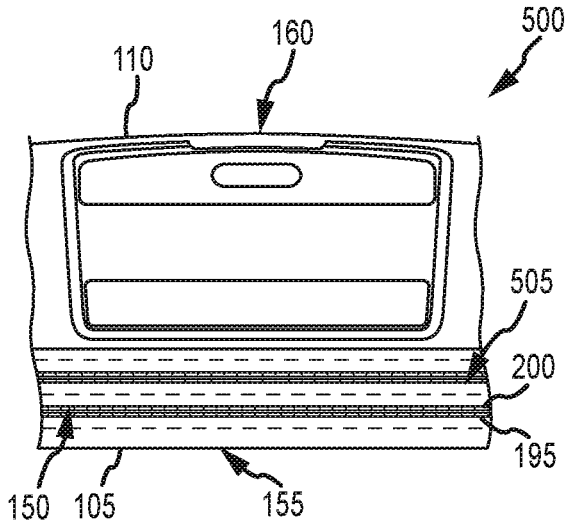
FIG. 34 shows a schematic partial top view of a fourth embodiment of a luggage piece that incorporates a recessed zipper and an expansion zipper, showing the expansion zipper in a closed position.
Figure 35:
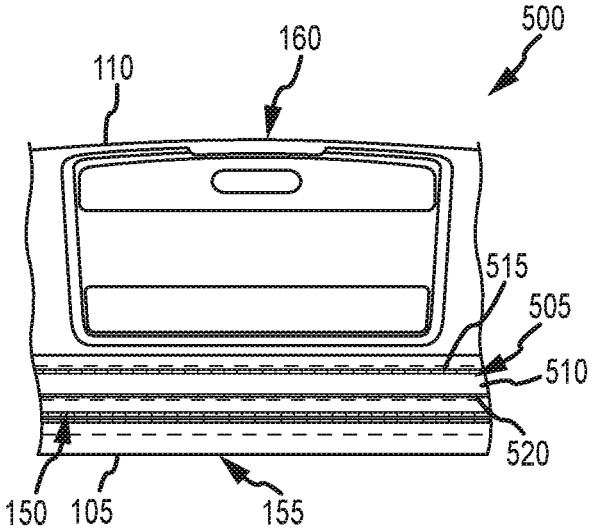
FIG. 35 shows a schematic partial top view of the luggage piece of FIG. 34, showing the expansion zipper in an open position.

FIGS. 34 and 35 show a schematic partial top view of a fourth embodiment of a luggage piece 500 that incorporates a recessed zipper. The fourth embodiment of the luggage piece 500 is similar to the first embodiment of the luggage piece 100 except a second zipper 505 is positioned adjacent to the first zipper 150. The second zipper 505 may be used to selectively expand the size of the luggage piece 500. In particular, when the second zipper 505 is configured to an open position as shown in FIG. 35, the front side 105 (or lid) of the luggage piece 500 may be moved away, in a transverse direction relative to the length of the second zipper 505, from the rear side 110 (or base) of the luggage piece. As the lid 155 moves away from the base 160, a gusset material 510 is exposed between the first and set sets of teeth 515, 520 of the second zipper 505. This gusset material 510 allows the lid 155 to be selectively moved away from the base 160 up to a predetermined distance. This capability to selectively move the lid 155 away from the base 160 allows for the area enclosed by the lid 155 and the base 160 to be selectively expanded. To return the luggage piece 500 to its unexpanded configuration, as shown in FIG. 34, the second zipper 505 may be configured into its closed position.

In the embodiment shown in FIGS. 34 and 35, the first set of teeth 195 for the first zipper 150 may be joined to the lid 155 via the first tape, and the other set of teeth 200 for the first zipper 150 may be joined to a first set of teeth 515 for the second zipper 505 via zippers tapes associated with each set of teeth 200, 515. The second set of teeth 520 for the second zipper 505 may be joined to the base 160 via a zipper tape associated with the second set of teeth 520. If desired, the positions of the first and second zippers 150, 505 could be reversed. More particularly, the first zipper 150 could be positioned proximate the base 160, and the second zipper 505 could be positioned proximate the lid 155.

The first and second zippers 150, 505 may be recessed in a similar manner as described above with respect to the first zipper 150 for the first, second or third embodiments of the luggage piece 100, 300, 400. Further, the first and second zippers 150, 505 may be recessed along portions or segments of their respective lengths, or may recessed along their entire lengths.

All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A luggage piece comprising:

a base;

a lid pivotally joined to the base to pivot between at least a first position where the base and the lid define a substantially enclosed space and a second position to allow access to the substantially enclosed space;

the lid and the base together defining an area recessed relative to outermost surfaces of the lid and the base when the lid and base are configured in the first position; and a zipper for maintaining the lid and the base in the first position, the zipper joined to the lid and the base at least within the recessed area such that the zipper is recessed relative to the outermost surfaces of the lid and the base within the recessed area;

wherein:

the zipper includes a zipper track and a zipper slider and a zipper tab;

the luggage piece further comprises a front side, a rear side, a left side, a right side, a top side and a bottom side, the lid being defined by the front side and portions of the right, left, top and bottom sides, the base being defined by the rear side and remaining portions of the right, left, top and bottom sides, and the right side being formed to define a pair of recessed area sidewalls that extend from the outermost surfaces of the right side toward the enclosed space;

a recessed area flange extends from each of the recessed area sidewalls proximate an inner recessed area sidewall end portion of its respective recessed area sidewall generally transversely from its respective recessed area sidewall towards the other recessed area sidewall, wherein each recessed area flange ends proximate the recessed area flange extending from the other recessed area sidewall; and the zipper track is joined to the recessed area flanges such that the zipper is aligned with the outermost surfaces.

2. The luggage piece of claim 1, wherein:

the zipper track is recessed relative to the outermost surfaces of the front side, rear side, left side, right side, top side and bottom side of the luggage piece along the length of the zipper track.

3. The luggage piece of claim 1, wherein the free ends of the recessed area flanges abut each other.

4. The luggage piece of claim 1, wherein each recessed area sidewall is spaced apart from the other recessed area sidewall at least a sufficient distance along the lengths of the recessed area sidewalls to accommodate a width of the zipper track.

5. The luggage piece of claim 1 wherein an outer facing surface of each recessed area sidewall is generally parallel to an outer facing surface of the other recessed area sidewall along the lengths of the recessed area sidewalls.

6. The luggage piece of claim 1 wherein the lid and the base are formed of a hard material joined by a piano-type hinge.

7. The luggage piece of claim 6 wherein the lid and the base are formed to define the recessed area.

8. The luggage piece of claim 1, wherein the zipper track is joined to the recessed area flanges, and a location of the recessed area flanges relative to the outermost surface of the right side of the luggage piece defines the depth that the zipper track is recessed relative to the outermost surface of the right side of the luggage piece.

9. The luggage piece of claim 8, wherein said depth that the zipper track is recessed relative to the outermost surface of the right side of the luggage piece is selected such that no portion of the zipper slider extends beyond the outermost surface of the right side of the luggage piece.

10. The luggage piece of claim 8, wherein said depth that the zipper track is recessed relative to the outermost surface of the right side as it transitions to the top side of the luggage piece is selected such that at least a portion of the zipper extends beyond the outermost surface of the right side of the luggage piece.

* * * * *